US009938095B2

(12) United States Patent
Kaiga et al.

(10) Patent No.: US 9,938,095 B2
(45) Date of Patent: Apr. 10, 2018

(54) STACKING DEVICE AND IMAGE FORMING APPARATUS

(71) Applicant: CANON KABUSHIKI KAISHA, Tokyo (JP)

(72) Inventors: Miho Kaiga, Suntou-gun (JP); Yasuhiko Fuse, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 14/968,503

(22) Filed: Dec. 14, 2015

(65) Prior Publication Data

US 2016/0185540 A1 Jun. 30, 2016

(30) Foreign Application Priority Data

Dec. 25, 2014 (JP) ..... 2014-262789

(51) Int. Cl.
*B65H 1/00* (2006.01)
*B65H 1/26* (2006.01)
*B65H 1/04* (2006.01)

(52) U.S. Cl.
CPC ..... *B65H 1/266* (2013.01); *B65H 1/04* (2013.01); *B65H 2403/47* (2013.01); *B65H 2403/53* (2013.01); *B65H 2403/55* (2013.01); *B65H 2511/11* (2013.01); *B65H 2511/20* (2013.01)

(58) Field of Classification Search
CPC ..... B65H 1/266; B65H 2511/12; B65H 2701/1131; B65H 1/00; B65H 2405/00; B65H 2405/1116; B65H 2405/112; B65H 2405/113; B65H 2405/114; B65H 2511/10
See application file for complete search history.

(56) References Cited

U.S. PATENT DOCUMENTS 8,045,216 B2 * 10/2011 Kobayashi ..... G03G 15/6502 271/171
8,087,664 B2 * 1/2012 Imai ..... B65H 1/266 271/171
8,113,506 B2 * 2/2012 Kaseda ..... B65H 1/266 271/145
2010/0052247 A1 * 3/2010 Kaseda ..... B65H 1/266 271/226

FOREIGN PATENT DOCUMENTS

JP 2005041646 A 2/2005
JP 2007223686 A 9/2007
JP 2010052858 A 3/2010
JP 2013006662 A 1/2013

* cited by examiner

*Primary Examiner* — Thomas A Morrison
(74) *Attorney, Agent, or Firm* — Canon USA, Inc., IP Division

(57) ABSTRACT

When an operating lever is moved from an operation position to a stand-by position, a standard size fixing member is lowered in advance of a non-standard size fixing member, so that a regulating member for regulating a position of an end portion of a sheet can be set to a desired position, enabling stable sheet feeding.

11 Claims, 23 Drawing Sheets

NON-STANDARD SIZE SIDE

STANDARD SIZE SIDE

NON-STANDARD SIZE SIDE

STANDARD SIZE SIDE

NON-STANDARD SIZE SIDE

STANDARD SIZE SIDE

NON-STANDARD SIZE SIDE

STANDARD SIZE SIDE

NON-STANDARD SIZE SIDE

STANDARD SIZE SIDE

NON-STANDARD SIZE SIDE

STANDARD SIZE SIDE

NON-STANDARD SIZE SIDE

STANDARD SIZE SIDE

NON-STANDARD SIZE SIDE

STANDARD SIZE SIDE

NON-STANDARD SIZE SIDE

STANDARD SIZE SIDE

NON-STANDARD SIZE SIDE

STANDARD SIZE SIDE

NON-STANDARD SIZE SIDE

STANDARD SIZE SIDE

NON-STANDARD SIZE SIDE

STANDARD SIZE SIDE

NON-STANDARD SIZE SIDE

STANDARD SIZE SIDE

NON-STANDARD SIZE SIDE

STANDARD SIZE SIDE

STACKING DEVICE AND IMAGE FORMING APPARATUS

BACKGROUND OF THE INVENTION

Field of the Invention

The present invention relates to a stacking device and an image forming apparatus.

Description of the Related Art

Conventionally, there have been widely used electrophotographic image forming apparatuses configured to convey a sheet to an image forming unit to form an image on the sheet. Such image forming apparatuses are provided with a sheet stacking tray serving as a sheet storage device. The sheet stacking tray can store various sizes of sheets in the same tray. To be specific, the sheet stacking tray is provided with a trailing edge regulating device and a width regulating unit in such a manner that their positions can be changed according to the size of the set sheet. The trailing edge regulating device regulates an upstream side of the sheet in a conveyance direction, and the width regulating unit regulates the position of the sheet in a width direction perpendicular to the conveyance direction.

As the various sizes of sheets, sheets having predetermined sizes typically defined by a standard (hereinafter, the sheets are referred to as standard-sized sheets, and the sizes are A4, A3, 8.5×11 inches, and 11×17 inches, for example), and sheets having sizes that do not correspond to the above-described sizes under the standard (hereinafter, the sheets are referred to as non-standard-sized sheets) are widely used in various ways.

For the use of the standard-sized sheets, in order to facilitate operations of the width regulating unit and the trailing edge regulating device performed by a user, some sheet stacking trays are provided with labels or engraved marks in positions corresponding to the sizes of the standard-sized sheets to indicate desired positions of the width regulating unit and the trailing edge regulating device. Further, some sheet stacking trays are configured to indicate that the regulating unit and the regulating device are located in desired positions, by a click or the like provided at the time of operations of the regulating unit and the regulating device.

However, when the standard-sized sheets are used, even if the sheet stacking tray is provided with the configuration for facilitating the operations of the width regulating unit and the trailing edge regulating device performed by the user, the operations may fail to be performed as intended by the user. That is, an operation for adjusting the position of the regulating unit or device to an indication such as the label or the engraved mark by visual observation, and the determination based on the click provided at the time of the operation of the regulating unit or device slightly vary depending on each user. Therefore, there is confirmed a case in which the regulating unit or device unintentionally overruns, and slightly deviates from a desired position to be fixed at the position.

For example, when the trailing edge regulating device is set to a shorter side of the sheets than a desired position, the sheets are compressed by the regulating unit more than necessary, and leading edges and trailing edges of the sheets are in a pressed state. As a result, there is problem that a sheet bundle is not lifted up in a swing lift plate due to friction between the leading edges of the sheets and a wall of a leading edge of the tray, or sheet feeding failure occurs due to a loss of lift pressure.

When the trailing edge regulating device is set to a longer side of the sheet than a desired position, a leading edge position of the sheets on the sheet stacking tray may be changed from a desired position, and therefore, a relative position between the sheets and a feed roller that feeds and conveys the sheets may be changed. As a result, there is a problem that such changes may lead to sheet feeding failure such as non-feeding.

Therefore, for example, as described in Japanese Patent Application No. 2007-223686, removing a positioning configuration of the trailing edge regulating device in a boundary of the standard-sized sheet and the non-standard-sized sheet clarifies a fixed position of the standard-sized sheet. As a result, an ideal position of the trailing edge regulating device to be set when the user uses the standard-sized sheet becomes easily-identifiable.

However, in the configuration described in Japanese Patent Application No. 2007-223686, in the vicinity of the position corresponding to the standard-sized sheet, the trailing edge regulating device may be positioned by neither a positioning mechanism of the standard size nor a positioning mechanism of the non-standard size. Since there is nothing to fix the position of the regulating device in a region where the positioning configuration of the regulating device is removed, when the trailing edge regulating device is used with slight deviation, the position of the regulating device changes during passing of the sheets. As a result, there is a problem that the sheet is obliquely conveyed.

SUMMARY OF THE INVENTION

According to an aspect of the present invention, a stacking device for stacking a sheet, includes a stacking portion on which a sheet is stacked, a regulating member, including a first engaging portion and a second engaging portion and provided on the stacking portion so as to be movable in a first direction and in a second direction that is an opposite direction to the first direction, configured to regulate a position of an end portion of the sheet, a first engaged portion provided in the stacking portion for positioning the regulating member to a position corresponding to a standard-sized sheet by being engaged with the first engaging portion, a second engaged portion provided in the stacking portion for positioning the regulating member to a position corresponding to a non-standard-sized sheet by being engaged with the second engaging portion, a moving member movable between a stand-by position and an operation position distant from the stand-by position, and a releasing unit including a first releasing unit configured to move the first engaging portion from a first engagement position where the first engaging portion is engaged with the first engaged portion to a first release position where the first engaging portion is not engaged with the first engaged portion, by the moving member moving to the operation position, and a second releasing unit configured to move the second engaging portion from a second engagement position where the second engaging portion is engaged with the second engaged portion to a second release position where the second engaging portion is not engaged with the second engaged portion, by the moving member moving to the operation position, wherein, when the moving member moves from the operation position to the stand-by position, the releasing unit moves the second engaging portion to the second engagement position after moving the first engaging portion to the first engagement position.

According to another aspect of the present invention, an image forming apparatus includes an image forming unit, a stacking portion on which a sheet on which an image is to be formed by the image forming unit is stacked, a regulating member, including a first engaging portion and a second engaging portion and provided on the stacking portion so as to be movable in a first direction and in a second direction that is an opposite direction to the first direction, configured to regulate a position of an end portion of the sheet, a first engaged portion provided in the stacking portion for positioning the regulating member to a position corresponding to a standard-sized sheet by being engaged with the first engaging portion, a second engaged portion provided in the stacking portion for positioning the regulating member to a position corresponding to a non-standard-sized sheet by being engaged with the second engaging portion, a moving member movable between a stand-by position and an operation position distant from the stand-by position, and a releasing unit including a first releasing unit configured to move the first engaging portion from a first engagement position where the first engaging portion is engaged with the first engaged portion to a first release position where the first engaging portion is not engaged with the first engaged portion, by the moving member moving to the operation position, and a second releasing unit configured to move the second engaging portion from a second engagement position where the second engaging portion is engaged with the second engaged portion to a second release position where the second engaging portion is not engaged with the second engaged portion, by the moving member moving to the operation position, wherein, when the moving member moves from the operation position to the stand-by position, the releasing unit moves the second engaging portion to the second engagement position after moving the first engaging portion to the first engagement position.

Further features of the present invention will become apparent from the following description of exemplary embodiments with reference to the attached drawings.

DESCRIPTION OF THE EMBODIMENTS

Figure 2:
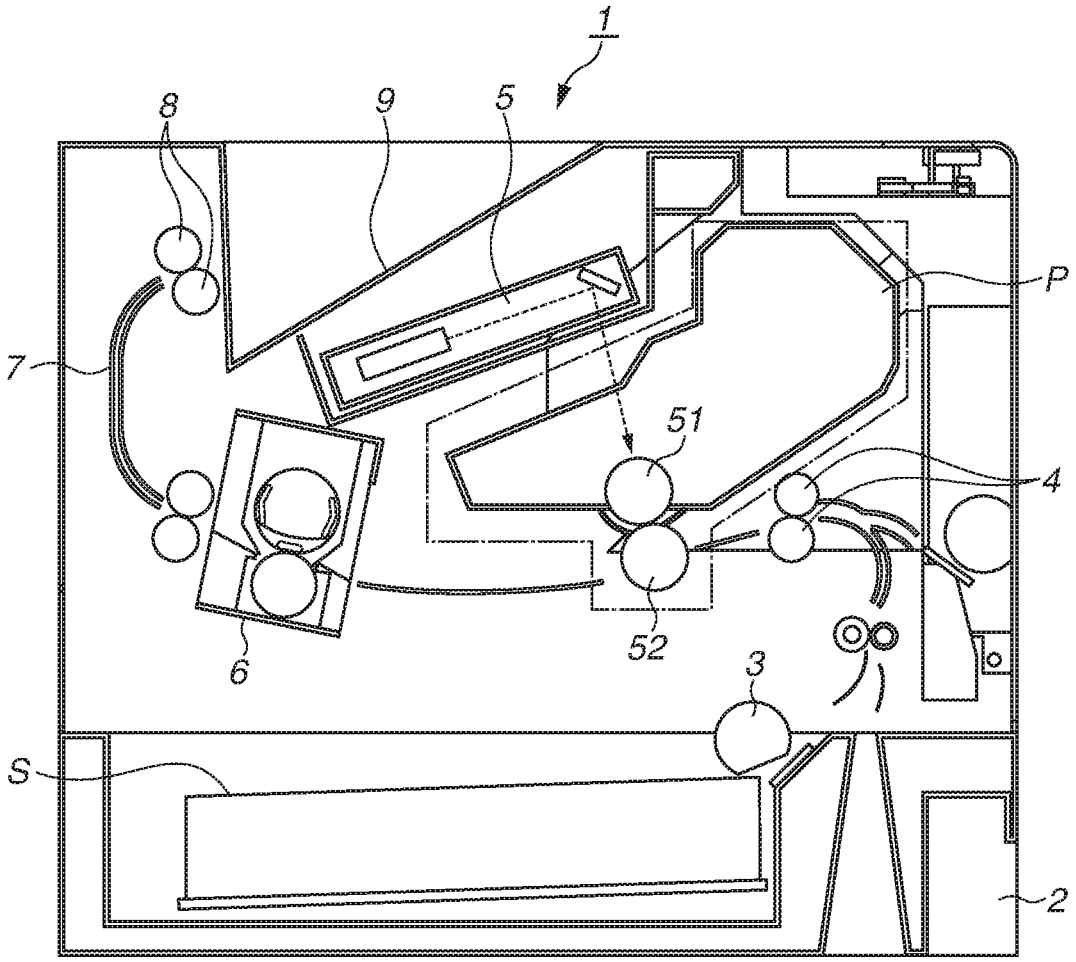
FIG. 2 is a sectional view illustrating an overall configuration of an image forming apparatus main body.

FIG. 2 is a schematic sectional view illustrating an overall configuration of an image forming apparatus. An image forming apparatus 1 forms an image by an electrophotographic recording system. The image forming apparatus 1 conveys a sheet (recording material) S to an image forming unit, transfers a toner image onto the sheet S, conveys the sheet S to a fixing unit, fixes the toner image, and discharges the sheet S to a discharge unit.

The sheets S are stacked and stored in a cassette 2 loaded in a lower portion of the apparatus. The sheets S are sequentially fed out one by one from an uppermost sheet S by a feed roller 3, and are fed to an image forming unit by a conveyance roller pair 4. Here, the image forming unit includes a photosensitive drum 51, a laser scanner 5 that writes an image onto the photosensitive drum 51, and a transfer roller 52 that transfers the toner image formed on the photosensitive drum 51, onto a recording material. These configurations are known, and thus detailed description is omitted. A cartridge P in FIG. 2 is a cartridge integrally formed with a process unit that acts on the photosensitive drum 51.

The sheet S on which an unfixed toner image is formed is fed to a fixing unit 6. The sheet S is subjected to fixing processing by being heated while passing through a fixing nip portion. Then, the sheet S is discharged outside the apparatus by a discharge roller pair 8 through a sheet discharge path 7, and is stacked on a discharge tray 9.

Figure 3:
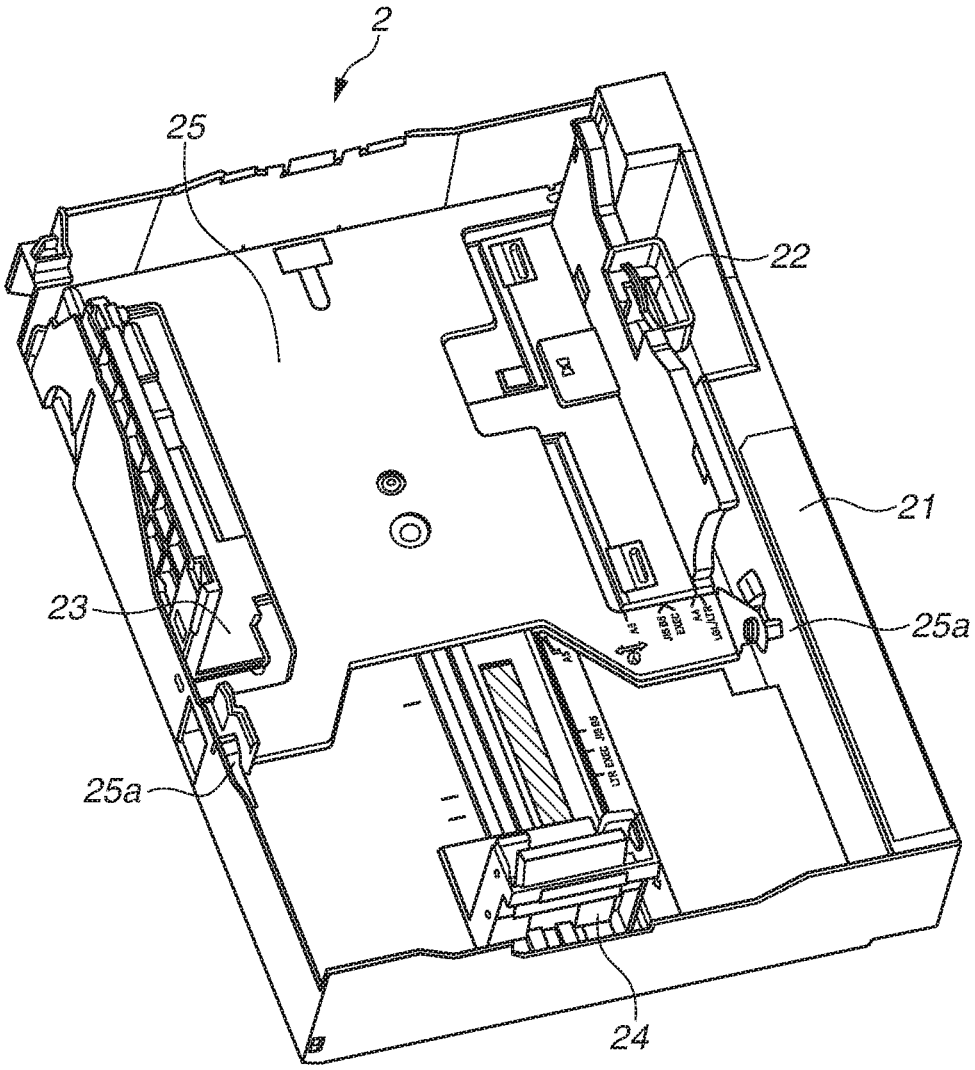
FIG. 3 is a perspective view illustrating a schematic configuration of a cassette provided in an image forming apparatus.

Next, a detailed configuration of the cassette 2 serving as a stacking device mounted on the image forming apparatus 1 will be described using FIGS. 3 to 5. FIG. 3 is a perspective view illustrating a schematic configuration of the cassette 2 that can store various sizes of the sheets S.

The cassette 2 illustrated in FIG. 3 includes a cassette main body 21 in which various sizes of the sheets S are stacked and stored, a pair of width regulating units 22 and 23 that regulate side end positions of the sheets S in a width direction that is a perpendicular direction to a conveyance direction of the sheets S, and a trailing edge regulating device 24 that regulates trailing edge positions of the sheets S. The cassette 2 further includes a middle plate 25 of a sheet stacking unit that turns around middle plate spindles 25*a*, and presses the stacked sheets S toward a feed roller. The width regulating units 22 and 23 and the trailing edge regulating device 24 are arranged in positions where these units 22 and 23 and the device 24 do not influence the turning operation of the middle plate (stacking portion) 25. Further, an upstream side of the sheets S is also supported by a portion (stacking portion) at a more upstream side than the middle plate 25.

Figure 4:
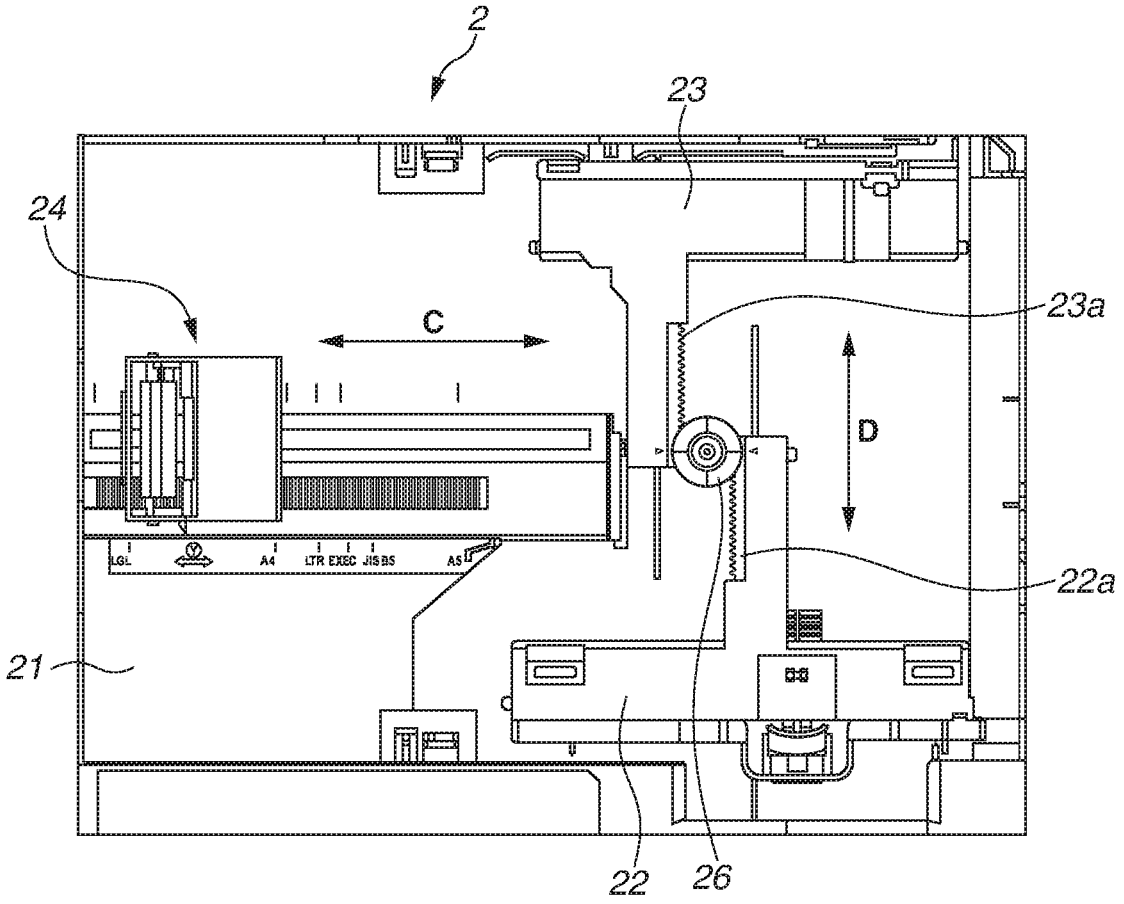
FIG. 4 is a plan view illustrating a schematic configuration of a cassette provided in the image forming apparatus.

FIG. 4 is a plan view illustrating the cassette 2 as viewed from above. In the pair of width regulating units 22 and 23, rack teeth formed in rack portions 22*a* and 23*a* extending in the same direction (the arrow D direction) as the width direction of the sheets S are meshed with a pinion 26. Accordingly, when either one of the width regulating units is moved in the width direction, the other width regulating unit is moved in an opposite direction to the one width regulating unit in conjunction with the one width regulating unit by an action of the pinion 26 and the rack portions 22*a* and 23*a*. The width regulating units 22 and 23 are positioned along a groove (not illustrated) provided in the cassette main body 21 and by fixing units (not illustrated) provided in the width regulating units 22 and 23.

The trailing edge regulating device 24 (regulating member) is freely movable in a sheet feeding direction of the sheets (first direction) and an opposite direction (second direction) opposite to the sheet feeding direction, along a guide groove provided in a bottom plate of the cassette main body 21 in the arrow C direction. Further, the trailing edge regulating device 24 is positioned along a groove (not illustrated) provided in the cassette main body 21 and by a fixing unit (not illustrated) provided in the trailing edge regulating device 24, similarly to the width regulating units 22 and 23.

Figure 5:
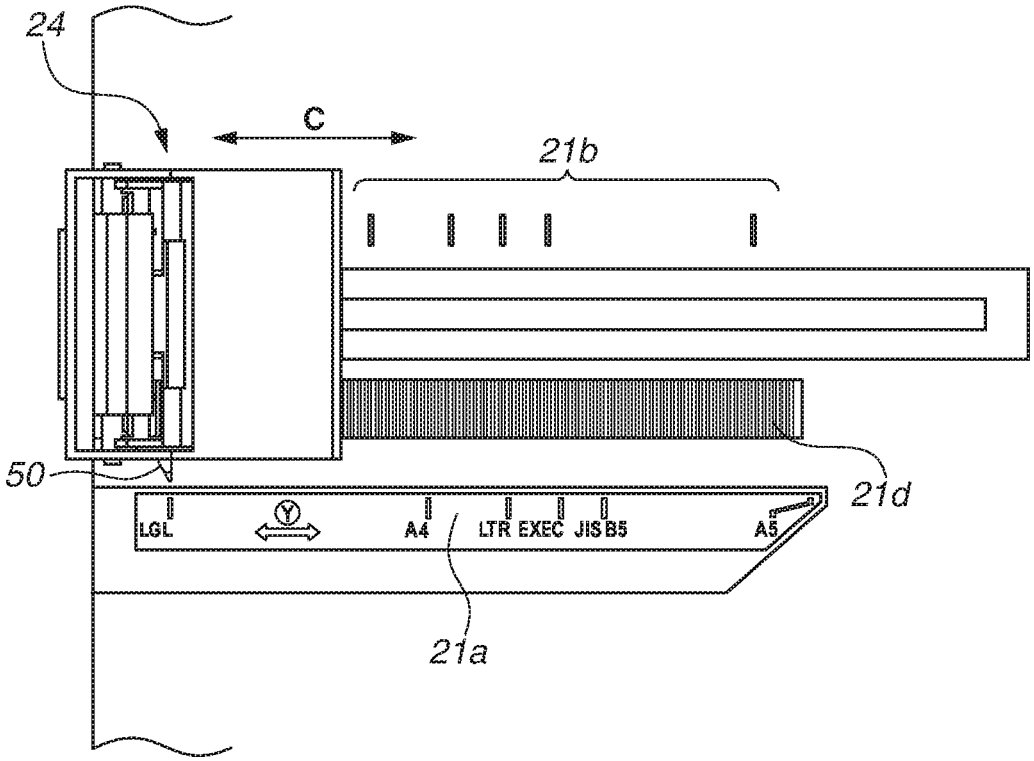
FIG. 5 is an enlarged plan view illustrating a schematic configuration of a cassette provided in the image forming apparatus.

FIG. 5 is an enlarged plan view illustrating the cassette 2 as viewed from above.

In the cassette main body 21, a display portion 21*a* that serves as a reference when the trailing edge regulating device 24 is stopped at respective positions of the standard sizes, and a plurality of cassette standard size fixing holes (first engaged portions) 21*b* corresponding to the positions are provided. A non-standard size rack gear (second engaged portion) 21*d* including a plurality of teeth is a protrusion portion having a rack shape for being engaged with a non-standard size fixing member (second engaging portion) 34 to be described below, and is arrayed throughout the entire region of the trailing edge regulating device 24 in the moving direction or in positions corresponding to non-standard sizes. The trailing edge regulating device 24 is configured to be movable in the arrow C direction, and the position thereof is fixed and held by the trailing edge regulating device 24 being engaged with the standard size fixing hole 21*b* and/or the non-standard size rack gear 21*d*. A mark portion 50 included in the trailing edge regulating device 24 is positioned in accordance with a mark corresponding to each size on the display portion 21*a*, according to the sheet size, so that the trailing edge regulating device 24 is positioned in a position corresponding to each size.

Figure 1:
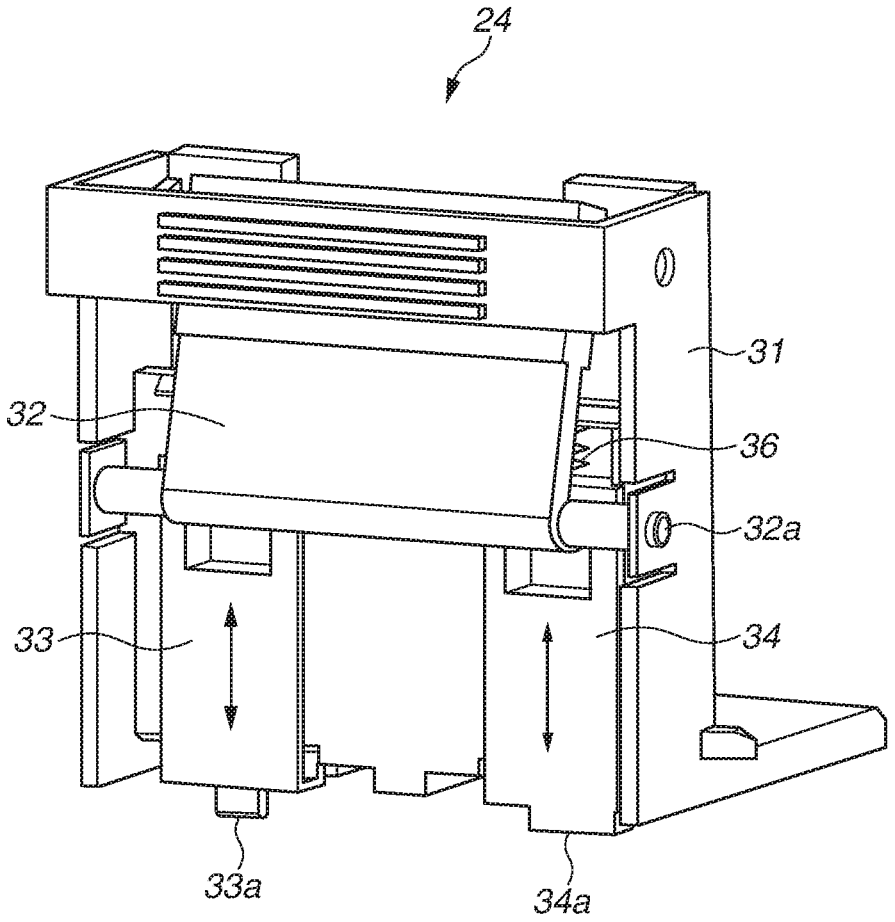
FIG. 1 is a perspective view illustrating a trailing edge regulating device according to a first exemplary embodiment.
Figure 6B:
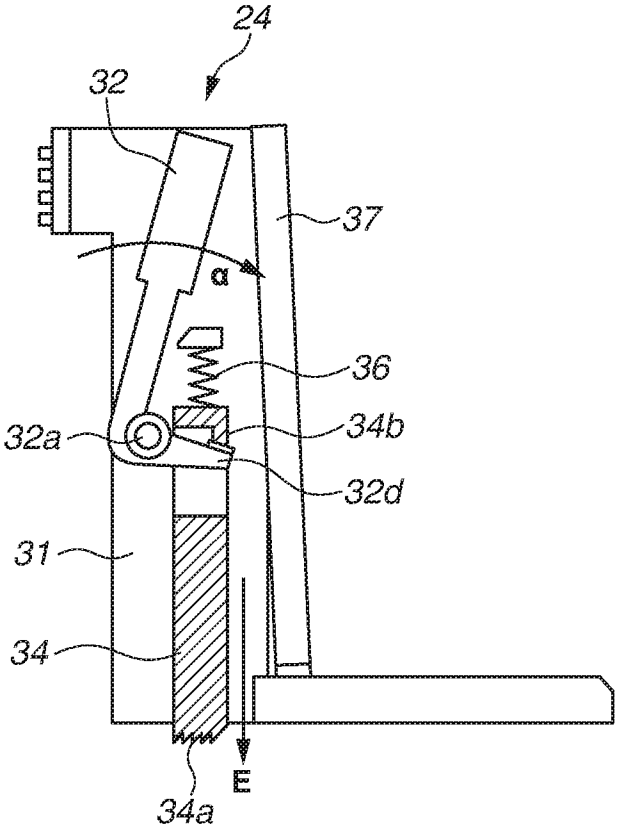
FIGS. 6A and 6B are sectional views illustrating an operation state of a trailing edge regulating device according to the first exemplary embodiment.
Figure 6A:
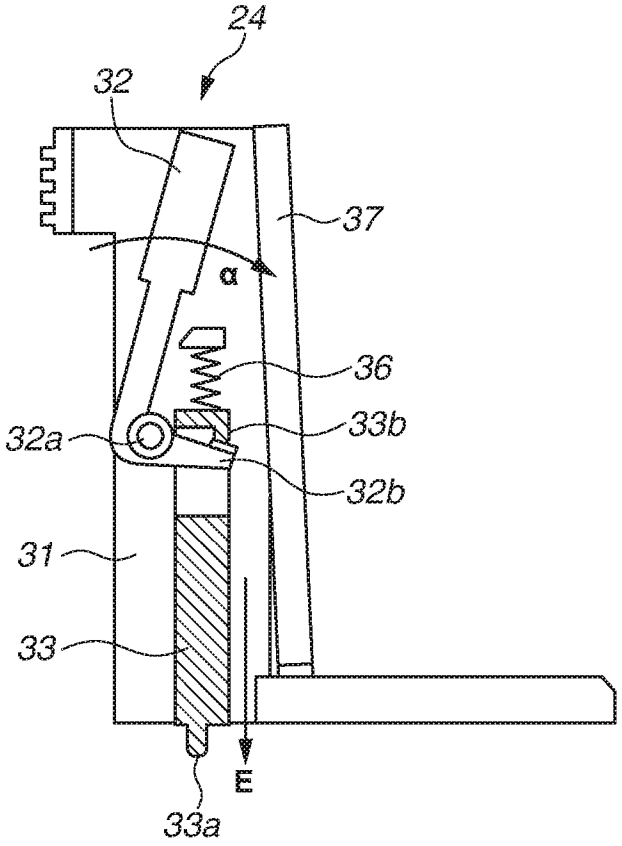

Next, details of the configuration of the trailing edge regulating device 24 will be described. FIG. 1 is a perspective view and FIGS. 6 and 7 are sectional views, of the trailing edge regulating device 24 according to the first exemplary embodiment of the present invention, and FIG. 8 is a perspective view illustrating a part of internal components of the trailing edge regulating device 24 from a rear side of the trailing edge regulating device 24 illustrated in FIG. 1.

As illustrated in FIG. 1, the trailing edge regulating device 24 includes a trailing edge regulating (holding member) case 31 that forms a frame for holding components in the trailing edge regulating device 24. The trailing edge regulating device 24 further includes a standard size fixing member 33 that fixes (positions) the trailing edge regulating device 24 in a position corresponding to the standard size, and a non-standard size fixing member 34 that fixes the trailing edge regulating device 24 in a position corresponding to the non-standard size. The standard size fixing member 33 and the non-standard size fixing member 34 (the two fixing members) are urged in a lower direction in FIG. 1 by elastic members 36. When a user operates an operating lever (operating member) 32 that turns around a rotation axis (turning center) 32*a*, the two fixing members are moved in an upper direction in FIG. 1 against elastic force of the elastic members 36, and the trailing edge regulating device 24 becomes movable with respect to the cassette 2. Here, the operating lever 32 is a moving member moved by being operated by the user.

Detailed description of an inside of the trailing edge regulating device 24 will be described using FIGS. 6A to 8.

The standard size fixing member 33 and the non-standard size fixing member 34 are engaged with grooves (not illustrated) provided in the trailing edge regulating case 31, and are configured to be linearly movable in the upper and lower direction (vertical direction). The elastic members 36 such as compression springs are respectively arranged above the standard size fixing member 33 and the non-standard size fixing member 34, and the standard size fixing member 33 and the non-standard size fixing member 34 receive the urging force in the lower direction (E direction). A flapper (pressing member) 37 has a contact surface of a sheet trailing edge portion.

The leading edge portion of the standard size fixing member 33 is provided with a standard size engaging portion (first engaging portion) 33*a* having a leading-in slope for being engaged with the standard size fixing hole 21*b* provided in the cassette 2 illustrated in FIG. 5. The leading edge portion of the non-standard size fixing member 34 is provided with a non-standard size engaging portion (second engaging portion) 34*a* having a teeth shape for being engage with (fit into) the non-standard size rack gear 21*d* provided in the cassette 2 illustrated in FIG. 5. The operating lever 32 turnable between a stand-by position and an operation position around the turning center 32*a* is held on the trailing edge regulating case 31, and is urged in an α direction (stand-by position) by an urging unit (not illustrated). When the user holds the operating lever 32, the operating lever 32 is turned in a β direction (operation position), and when the user releases the hand, the operating lever 32 is turned in the α direction (stand-by position). The leading edge of the operating lever 32 is provided with a lever contact portion 32*b* that comes into contact with a standard size contact portion 33*b* and a lever contact portion 32*d* that comes into contact with a non-standard size contact portion 34*b*.

Figure 7B:
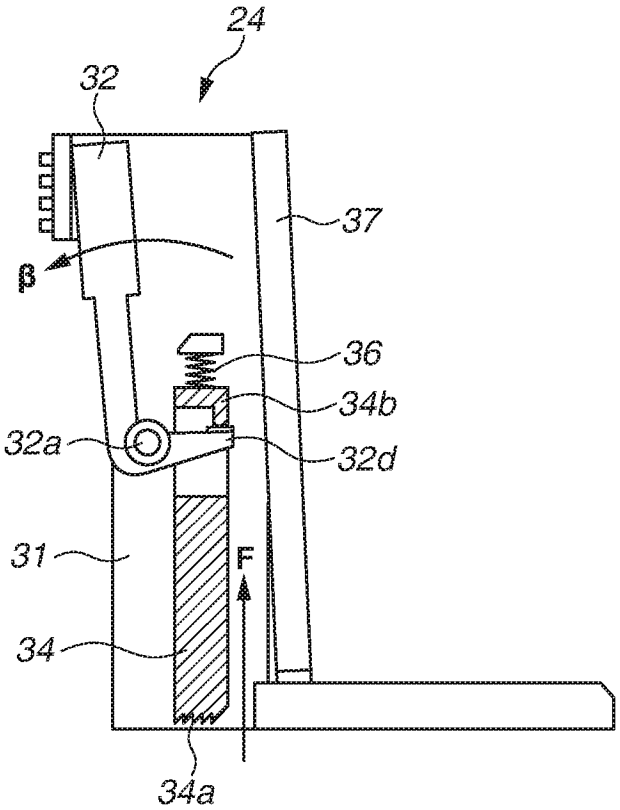
FIGS. 7A and 7B are sectional views illustrating an operation state of the trailing edge regulating device according to the first exemplary embodiment.
Figure 7A:
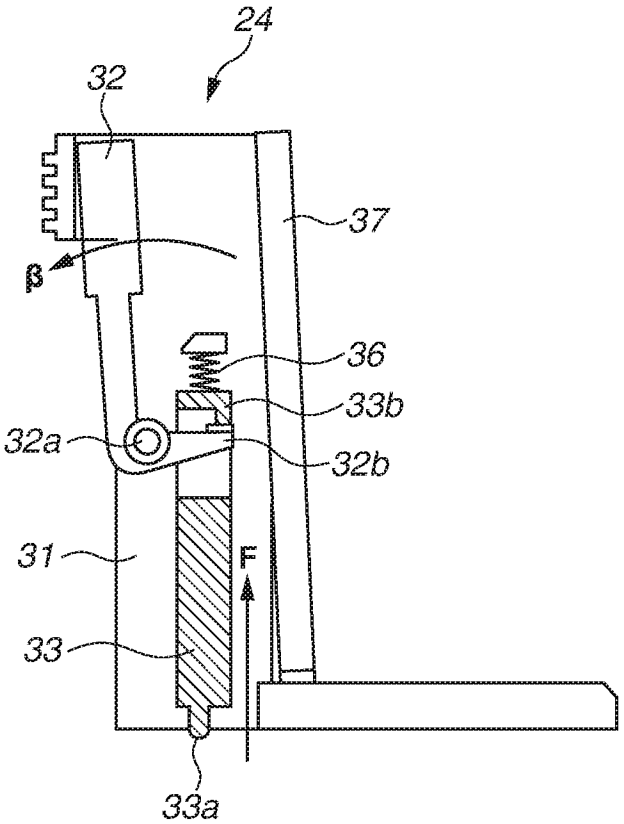
Figure 8:
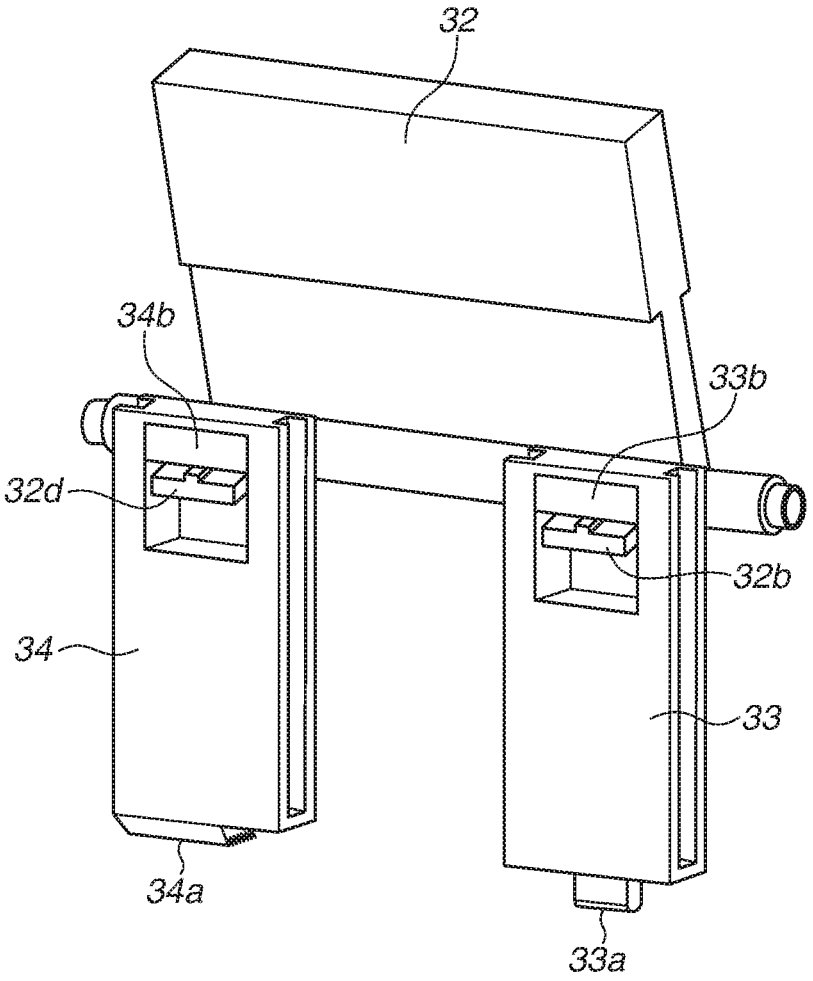
FIG. 8 is a perspective view illustrating the trailing edge regulating device according to the first exemplary embodiment.

FIGS. 7A and 7B illustrate a state where the user has operated the operating lever 32.

When the user operates the operating lever 32, the lever contact portion 32*b* pushes up the standard size contact portion 33*b* in accordance with the turning of the operating lever 32 in the R direction, and the standard size fixing member 33 is moved in the upper direction (F direction). Further, the lever contact portion 32*d* pushes up the non-standard size contact portion 34*b*, and the non-standard size fixing member 34 is moved in the upper direction (F direction). Accordingly, the trailing edge regulating device 24 becomes movable with respect to the cassette 2. When the user releases the hand from the operating lever 32, the operating lever 32 turns in the α direction (FIGS. 6A and 6B), and the lever contact portions 32*b* and 32*d* are moved in the lower direction. Accordingly, the standard size fixing member 33 and the non-standard size fixing member 34 are moved in the lower direction (E direction) by the elastic force of the elastic members 36. That is, in the first exemplary embodiment, the standard size engaging portion 33*a* is moved from a first engagement position where the standard size engaging portion 33*a* is engaged with the standard size fixing hole 21*b* to a first release position where the standard size engaging portion 33*a* is not engaged with the standard size fixing hole 21*b*, in conjunction with the operating lever 32 moving from the stand-by position to the operation position. Further, in the first exemplary embodiment, the non-standard size engaging portion 34*a* is moved from a second engagement position where the non-standard size engaging portion 34*a* is engaged with the rack gear 21*d* to a second release position where the non-standard size engaging portion 34*a* is not engaged with the rack gear 21*d*, in conjunction with the operating lever 32 moving from the stand-by position to the operation position. In the first exemplary embodiment, the lever contact portion 32*b* and the standard size contact portion 33*b* form a first releasing unit that moves the standard size fixing member 33 between the first engagement position and the first release position. Further, the lever contact portion 32*d* and the non-standard size contact portion 34*b* form a second releasing unit that moves the non-standard size fixing member 34 between the second engagement position and the second release position. Therefore, a releasing unit includes the lever contact portion 32*b*, the standard size contact portion 33*b*, the lever contact portion 32*d*, and the non-standard size contact portion 34*b*, and the releasing unit is a part of the trailing edge regulating device 24.

Here, in the first exemplary embodiment, the standard size contact portion 33*b* and the non-standard size contact portion 34*b* are configured to have protrusions with different lengths. Thus, in accordance with a predetermined turning operation of the operating lever 32, the non-standard size fixing member 34 operates for a longer distance than the standard size fixing member 33 operates.

Therefore, when the user releases the hand from the operating lever 32 (in the middle of the turning of the operating lever 32 from the operation position to the stand-by position), the standard size fixing member 33 is lowered and comes into contact with the cassette main body 21 in advance of the non-standard size fixing member 34. Further, when the user loosens the operating lever 32 halfway (in an intermediate position between the operation position and the stand-by position), the standard size fixing member 33 comes into contact with the cassette main body 21. In contrast, the non-standard size fixing member 34 does not yet come into contact with the cassette main body 21.

Next, engagement operations of the standard size engaging portion 33*a* and the non-standard size engaging portion 34*a* with the cassette 2 will be described in detail using FIGS. 9A to 13B.

Figure 11B:
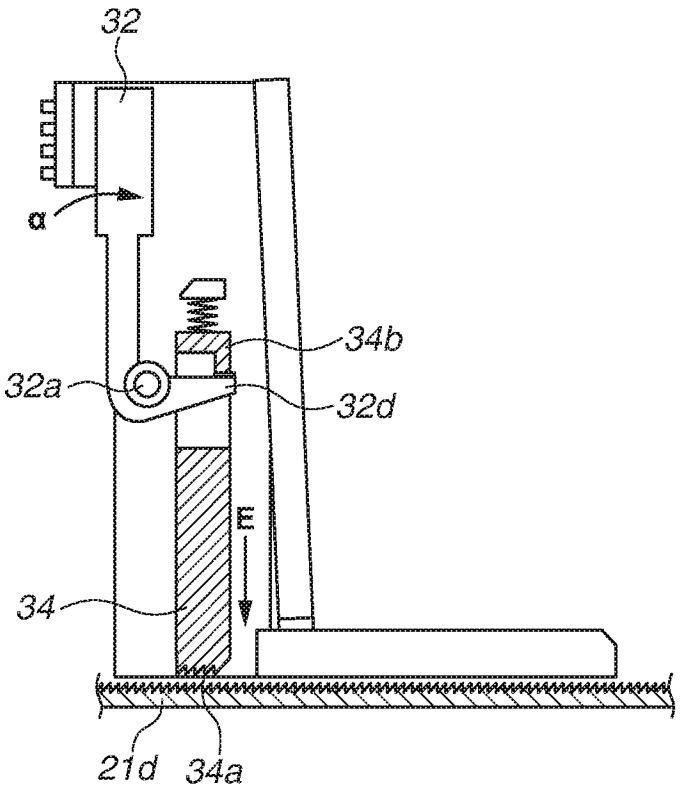
FIGS. 11A and 11B are sectional views illustrating an operation state of the trailing edge regulating device according to the first exemplary embodiment.
Figure 11A:
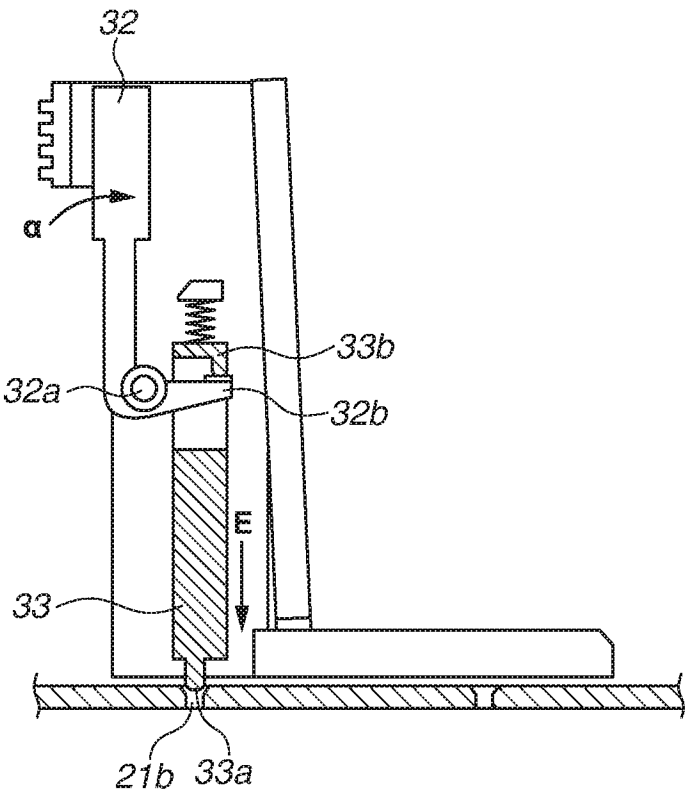
Figure 12B:
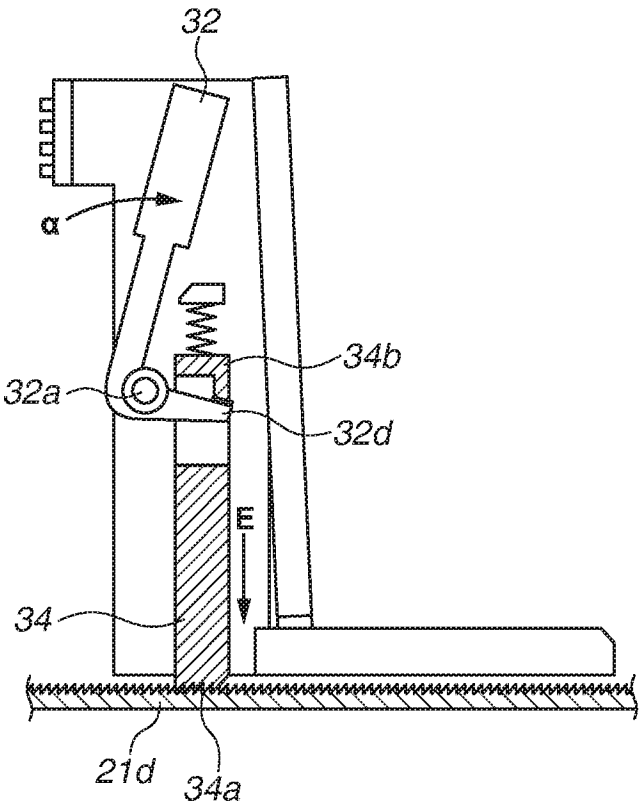
FIGS. 12A and 12B are sectional views illustrating an operation state of the trailing edge regulating device according to the first exemplary embodiment.
Figure 12A:
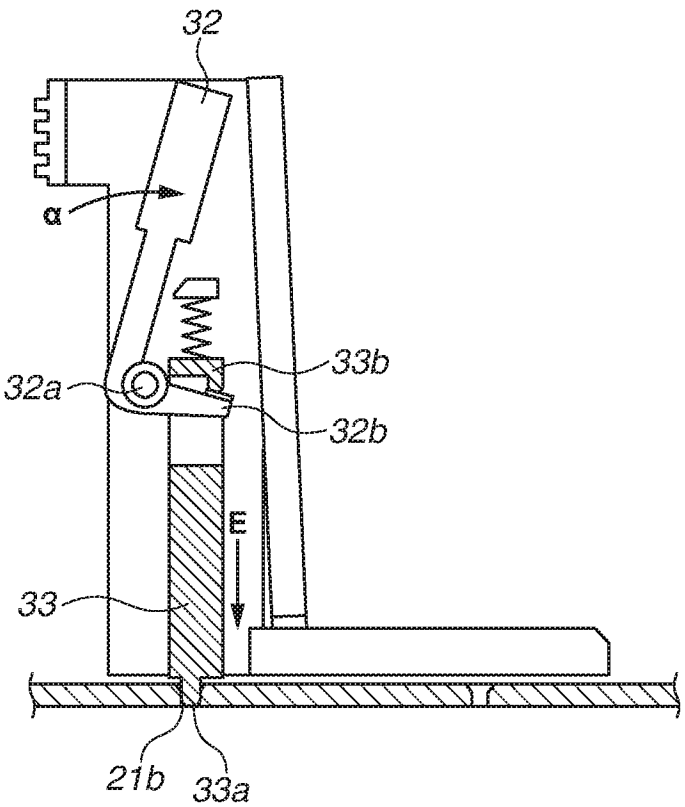
Figure 13B:
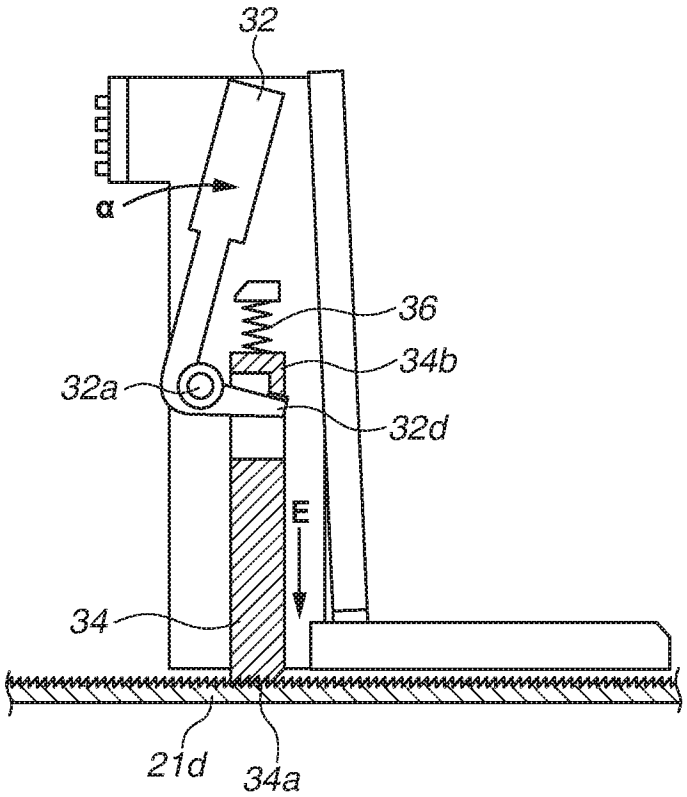
FIGS. 13A and 13B are sectional views illustrating an operation state of the trailing edge regulating device according to the first exemplary embodiment.
Figure 13A:
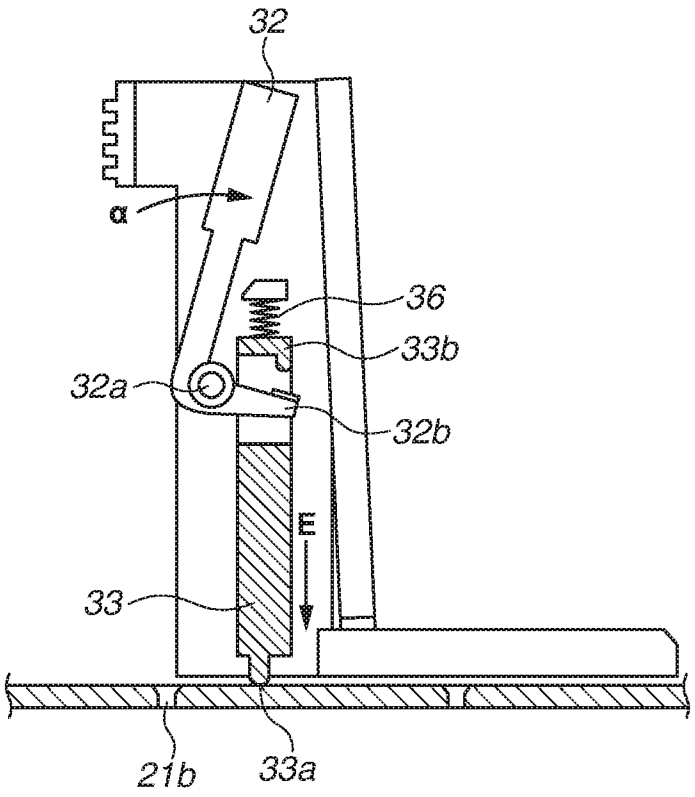

FIGS. 9A to 10B are diagrams illustrating a halfway state where the user sets the trailing edge regulating device 24 to a desired position. FIGS. 11A and 11B are diagrams illustrating a case in which the user has correctly set the trailing edge regulating device 24 to a standard size position. FIGS. 12A and 12B are diagrams illustrating a case in which the user has correctly set the trailing edge regulating device 24 to the standard size position, and has released the hand. FIGS. 13A and 13B are diagrams illustrating a case in which the user has set the trailing edge regulating device 24 to a non-standard size position.

Figure 9B:
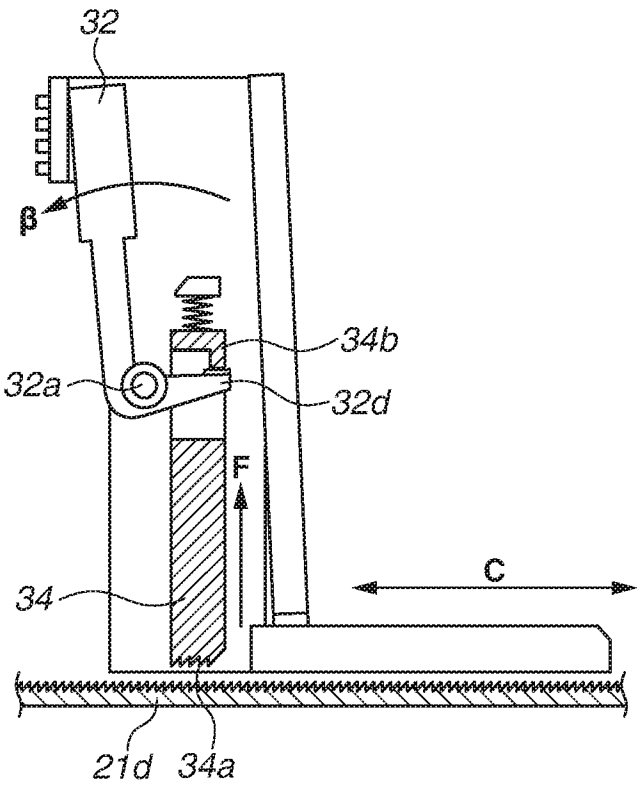
FIGS. 9A and 9B are sectional views illustrating an operation state of the trailing edge regulating device according to the first exemplary embodiment.
Figure 9A:
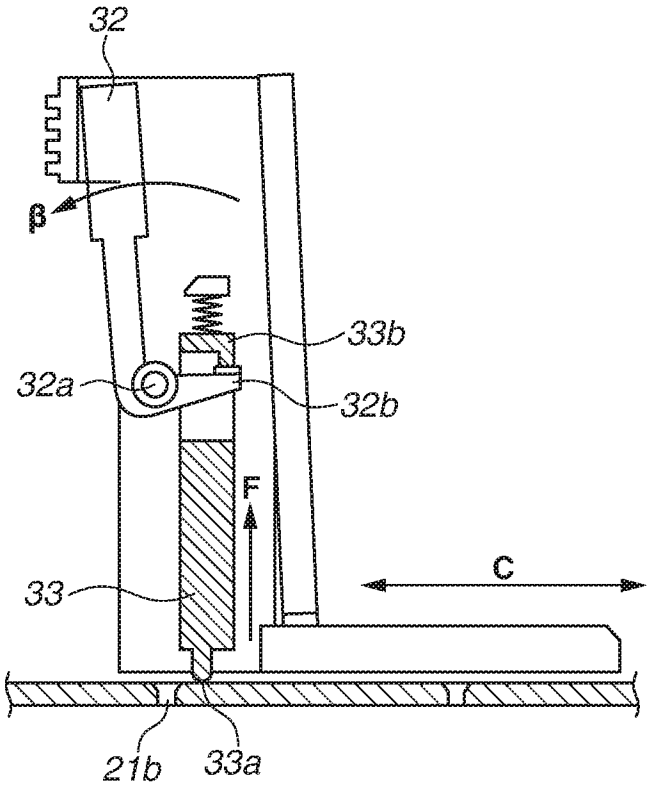

FIG. 9A illustrates a state of the standard size fixing member 33, and FIG. 9B illustrates a state of the non-standard size fixing member 34. The operating lever 32 pressed by the user turns to the end (the operation position) in the β direction, and both of the standard size fixing member 33 and the non-standard size fixing member 34 are pushed up and positioned in the upper direction (F direction).

Accordingly, the standard size engaging portion 33*a* and the non-standard size engaging portion 34*a* enter states of being respectively separated from the standard size fixing hole 21*b* and the non-standard size rack gear 21*d*. Therefore, there is nothing to regulate the position of the trailing edge regulating device 24 in the C direction, so that the trailing edge regulating device 24 becomes freely movable in the C direction with respect to the cassette main body 21, and the user can move the trailing edge regulating device 24 to a desired position.

Figure 10B:
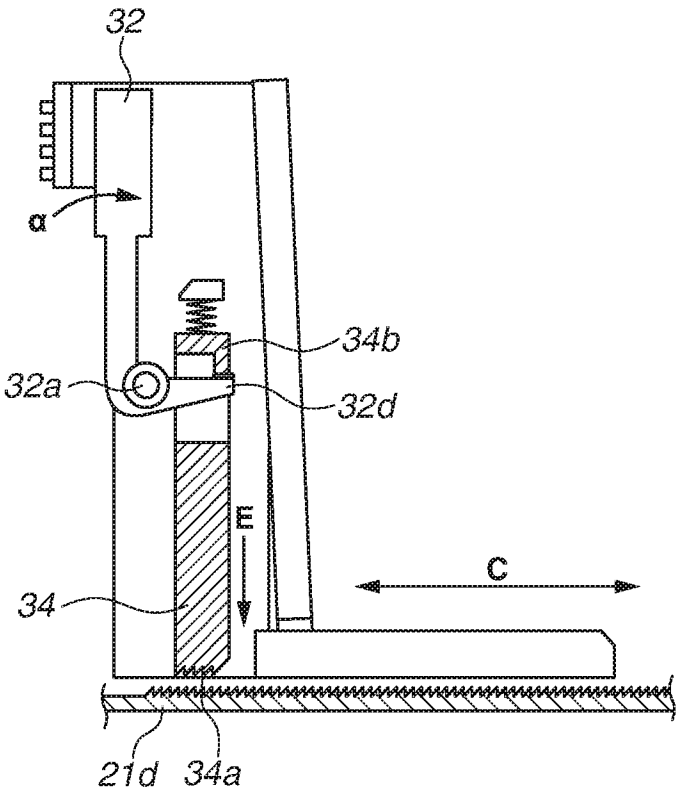
FIGS. 10A and 10B are sectional views illustrating an operation state of the trailing edge regulating device according to the first exemplary embodiment.
Figure 10A:
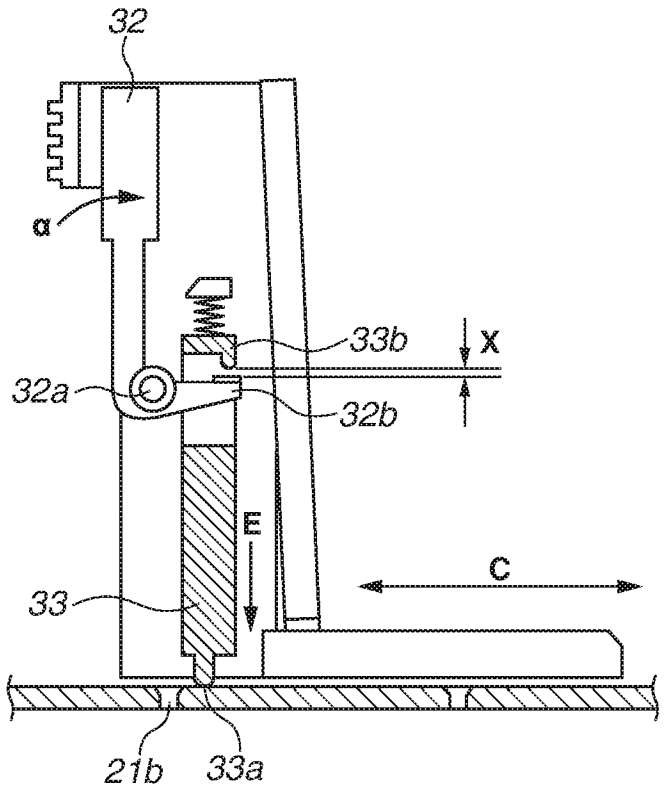

FIGS. 10A and 10B illustrate a state where the user slightly returns the operating lever 32 in the α direction (intermediate position). As illustrated in FIG. 10A, the standard size engaging portion 33*a* reaches a flat portion of the cassette main body 21 to stop thereat. At this time, a predetermined clearance X exists between the operating lever contact portion 32*b* and the standard size contact portion 33*b*. The standard size engaging portion 33*a* is moved on the flat portion of the cassette main body 21 while pressing the flat portion of the cassette main body 21. Meanwhile, as illustrated in FIG. 10B, the non-standard size engaging portion 34*a* has not been lowered to the position where the non-standard size engaging portion 34*a* is engaged with the rack gear 21*d*.

As illustrated in FIGS. 11A and 11B, when the user moves the trailing edge regulating device 24 to the position corresponding to the standard size, the standard size engaging portion 33*a* reaches the cassette standard size fixing hole 21*b*, and the standard size fixing member 33 is lowered by the clearance X. Accordingly, the standard size engaging portion 33*a* is engaged with the standard size fixing hole 21*b*, and the trailing edge regulating device 24 is positioned with respect to the cassette main body 21. At this time, as illustrated in FIG. 11B, the non-standard size engaging portion 34*a* has not been lowered to the position where the non-standard size engaging portion 34*a* is engaged with the rack gear 21*d*. That is, a timing at which the standard size engaging portion 33*a* is engaged with the standard size fixing hole 21*b* is earlier than a timing at which the non-standard size engaging portion 34*a* is engaged with the rack gear 21*d*. Therefore, the user can reliably set the trailing edge regulating device 24 to the position corresponding to the standard size.

FIGS. 12A and 12B illustrate a state where the user has released the hand from the operating lever 32. The operating lever 32 is fully turned to the α direction (stand-by position), and the standard size fixing member 33 and the non-standard size fixing member 34 are moved in the lower direction (E direction), so that the moving operation of the trailing edge regulating device 24 performed by the user is completed. In this state, as illustrated in FIG. 12B, the non-standard size engaging portion 34*a* is lowered to the position where the non-standard size engaging portion 34*a* is engaged with the rack gear 21*d*. The user can further move the trailing edge regulating device 24 to a position corresponding to another standard size by repeating the above-described operation.

Next, the description will be given of an operation performed when the user moves the trailing edge regulating device 24 from the position corresponding to the standard size to the position corresponding to the non-standard size.

As illustrated in FIGS. 9A and 9B, first, the user turns the operating lever 32 to the end in the 3 direction. Next, the user moves the trailing edge regulating device 24 in the C direction to a desired position while pressing the operating lever 32.

As illustrated in FIGS. 13A and 13B, the user releases the hand from the operating lever 32 after moving the trailing edge regulating device 24 to the desired position, so that the operating lever 32 fully turns in the α direction (stand-by position). Accordingly, the standard size fixing member 33 and the non-standard size fixing member 34 are lowered. Then, only the non-standard size engaging portion 34*a* enters a state of being engaged with the non-standard size rack gear 21*d*. At this time, the standard size fixing member 33 is pressed in the lower direction by the elastic member 36, and the standard size engaging portion 33*a* comes into contact with the flat portion of the cassette main body 21 to stop thereat. That is, in the position corresponding to the non-standard size, the standard size engaging portion 33*a* and the standard size fixing hole 21*b* are not concerned with a fixing operation of the trailing edge regulating device 24 in the C direction.

As described above, according to the first exemplary embodiment, when the operating lever 32 is moved from the operation position to the stand-by position, the standard size fixing member 33 is lowered in advance of the non-standard size fixing member 34. Therefore, when the user wishes to set the trailing edge regulating device 24 to the position corresponding to the standard size, the user can reliably engage the standard size engaging portion 33*a* of the trailing edge regulating device 24 with the standard size fixing hole 21*b*.

Further, according to the first exemplary embodiment, the non-standard size rack gear 21*d* can be provided throughout the entire region of a movable range of the trailing edge regulating device 24. Therefore, even in a state where the standard size engaging portion 33*a* is engaged with the standard size fixing hole 21*b*, only the non-standard size engaging portion 34*a* enters a state of being engaged with the non-standard size rack gear 21*d*. Therefore, force for holding the trailing edge regulating device 24 positioned in the position corresponding to the standard size, on the cassette main body 21 can be made strong, and positioning accuracy of the trailing edge regulating device 24 can be improved.

As illustrated in FIGS. 10A and 10B, if there is a unit that provides a click or the like, which enables the user to recognize that the operating lever 32 is positioned in the intermediate position between the stand-by position and the operation position, operability can be further improved.

Further, in the present exemplary embodiment, the description has been given of a configuration in which the lengths of the protrusions of the standard size contact portion 33*b* and the non-standard size contact portion 34*b* are different. However, if the lever contact portions 32*b* and 32*d* are configured to have protrusions with different lengths, a similar effect can be obtained.

Hereinafter, a second exemplary embodiment will be described. In the description of the second exemplary embodiment below, description of configurations and operations similar to the first exemplary embodiment are appropriately omitted.

Figure 14:
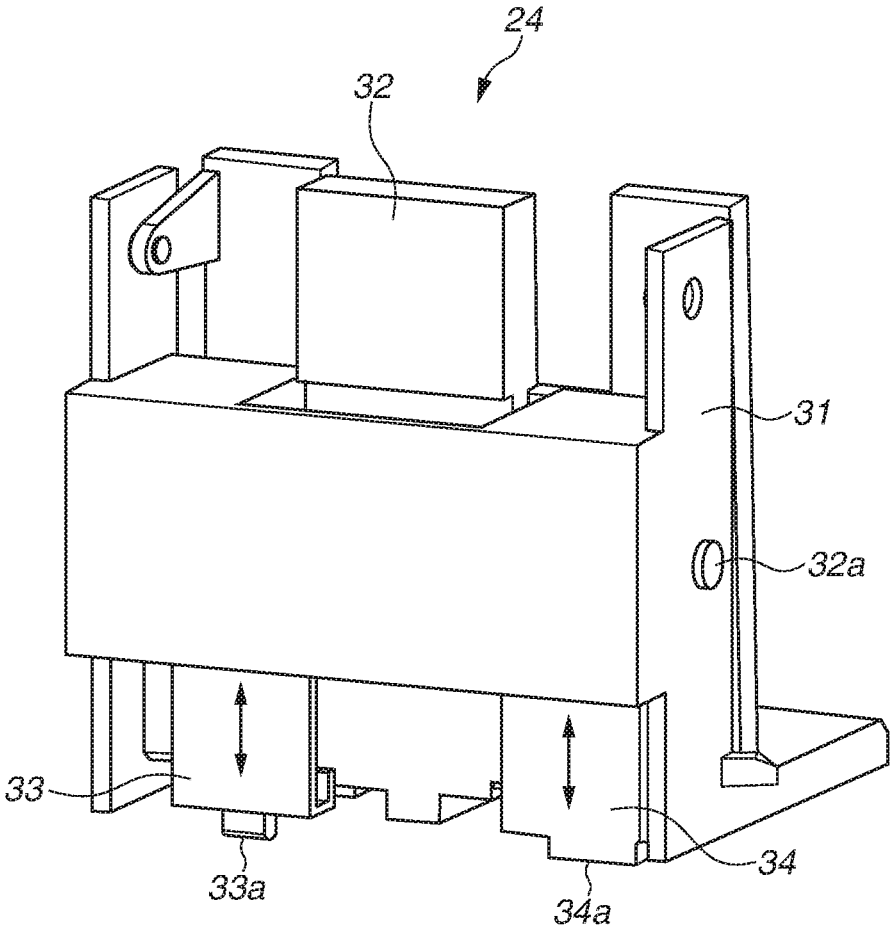
FIG. 14 is a perspective view illustrating a trailing edge regulating device according to a second exemplary embodiment.
Figure 15:
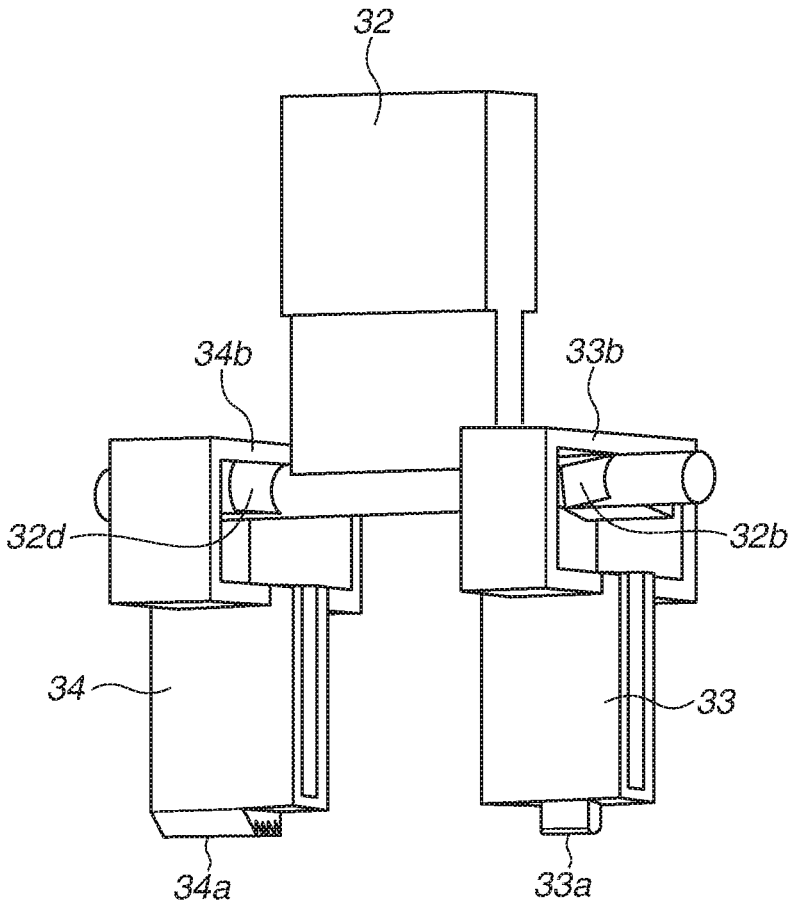
FIG. 15 is a perspective view illustrating the trailing edge regulating device according to the second exemplary embodiment.

Details of a configuration of a trailing edge regulating device according to the second exemplary embodiment will be described. FIG. 14 is a perspective view illustrating a trailing edge regulating device 24 according to the second exemplary embodiment. FIG. 15 is a perspective view illustrating a part of internal components of the trailing edge regulating device 24 from a rear side of the trailing edge regulating device 24 illustrated in FIG. 14. FIGS. 16A to 17B are sectional views.

Figure 16B:
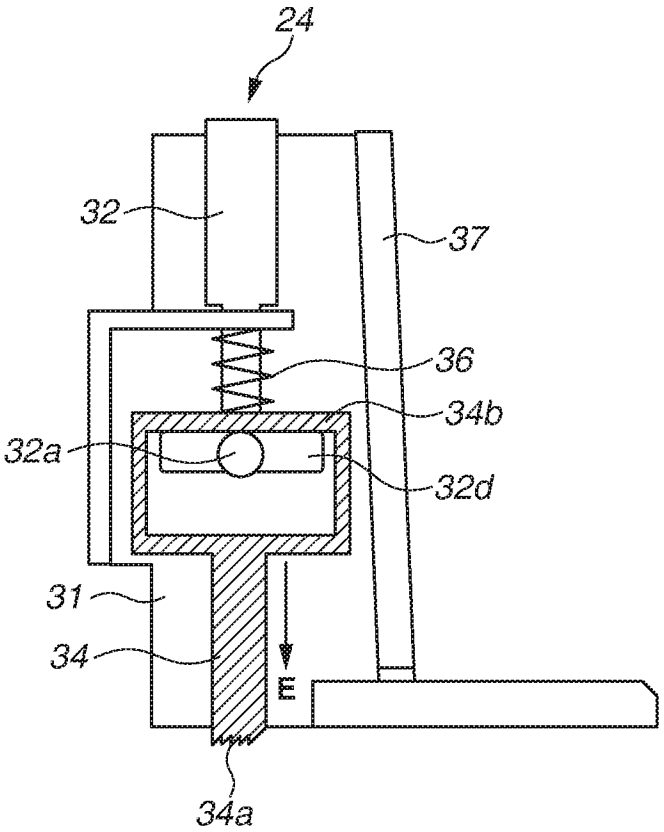
FIGS. 16A and 16B are sectional views illustrating an operation state of the trailing edge regulating device according to the second exemplary embodiment.

The second exemplary embodiment is different from the first exemplary embodiment in a mechanism for operating (lifting) a standard size fixing member 33 and a non-standard size fixing member 34 according to the turning of an operating lever 32. As illustrated in FIGS. 15 to 16B, in the second exemplary embodiment, shapes of an operating lever contact portion 32*b* and an operating lever contact portion 32*d* are different from each other.

Figure 16A:
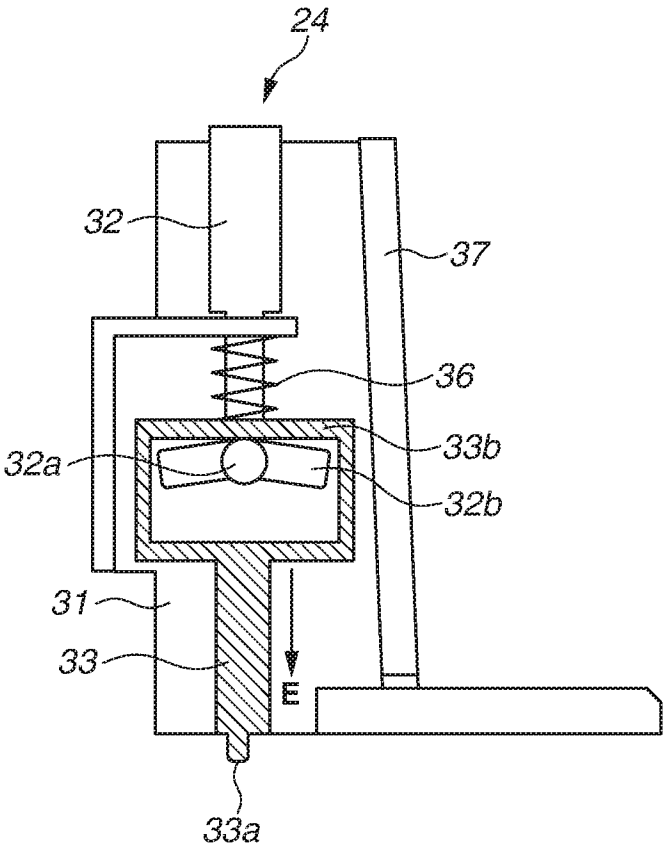

As illustrated in FIG. 16A, the lever contact portion 32*b* that vertically moves the standard size fixing member 33 in conjunction with the turning of the operating lever 32 has two surfaces. Further, as illustrated in FIG. 16B, the lever contact portion 32*d* that vertically moves the non-standard size fixing member 34 in conjunction with the turning of the operating lever 32 also has two surfaces.

In the state illustrated in FIGS. 16A and 16B, the operating lever 32 is positioned in a stand-by position where the operating lever 32 is not pressed by the user. In this state, the two fixing members are pressed downward by elastic force of elastic members 36. In this state, both of the two surfaces of the lever contact portion 32*b* are not in contact with a standard size contact portion 33*b*. In contrast, both of the two surfaces of the lever contact portion 32*d* are in contact with the non-standard size contact portion 34*b*.

Figure 17B:
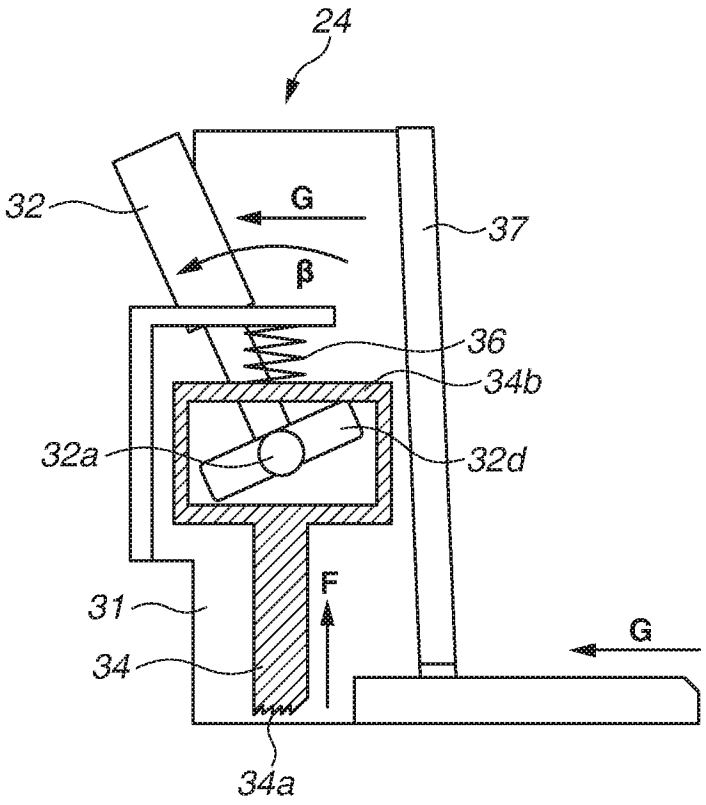
FIGS. 17A and 17B are sectional views illustrating an operation state of the trailing edge regulating device according to the second exemplary embodiment.
Figure 17A:
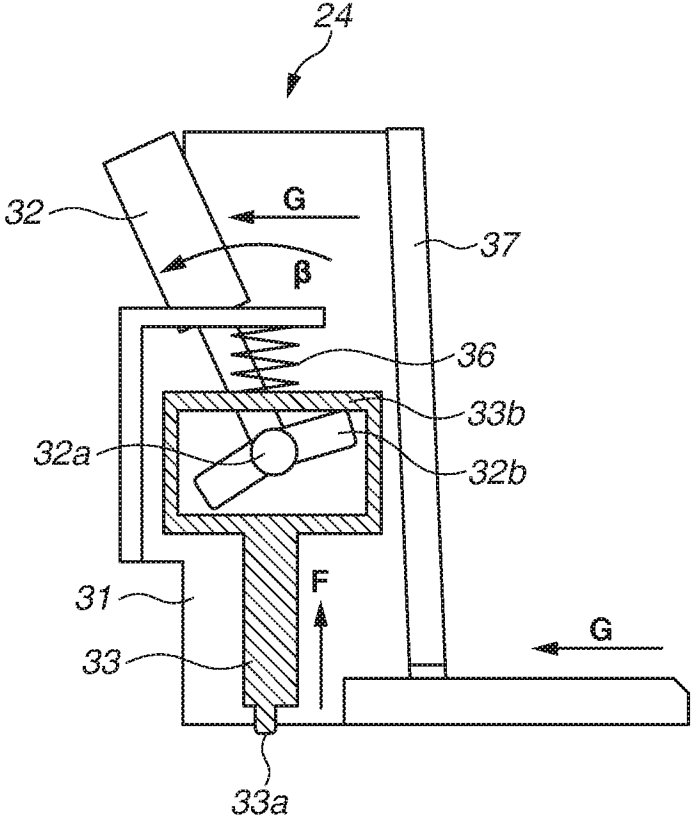

FIGS. 17A and 17B illustrate a state where the user turns the operating lever 32 from the stand-by position to an operation position.

The user presses the operating lever 32 in a G direction, so that the operating lever 32 is turned in a β direction. Accordingly, the lever contact portion 32*b* pushes up the standard size contact portion 33*b*, and the standard size fixing member 33 is moved in an upper direction (F direction). Further, the lever contact portion 32*d* pushes the non-standard size contact portion 34*b*, and the non-standard size fixing member 34 is moved in the upper direction (F direction). Accordingly, the trailing edge regulating device 24 becomes movable with respect to a cassette main body 21. Further, when the user continues to press the operating lever 32 in the G direction, the entire trailing edge regulating device 24 is moved in the G direction.

When the user releases the hand from the operating lever 32, the operating lever 32 is returned from the operation position to the stand-by position (FIGS. 16A and 16B). In conjunction with this movement of the operating lever 32, the lever contact portions 32*b* and 32*d* are moved in a lower direction, so that the standard size fixing member 33 and the non-standard size fixing member 34 are moved in the lower direction (E direction) by elastic force of the elastic members 36.

Here, in the second exemplary embodiment, the lever contact portion 32*b* and the lever contact portion 32*d* are configured to have different shapes. Thus, in accordance with a turning operation of the operating lever 32, the non-standard size fixing member 34 operates for a longer distance than the standard size fixing member 33 operates. Therefore, when the user loosens the force for pressing the operating lever 32 (in the middle of the turning of the operating lever 32 from the operation position to the stand-by position), the standard size fixing member 33 is lowered and comes into contact with the cassette main body 21 in advance of the non-standard size fixing member 34.

Operating force in the G direction that is necessary for separating the non-standard size fixing member 34 from a rack gear 21*d* is represented by A (second operating force). Further, operating force in the G direction that is necessary for separating the non-standard size fixing member 34 from the rack gear 21*d*, and further separating the standard size fixing member 33 from a standard size fixing hole 21*b* is represented by C (first operating force). Further, sliding resistance between the trailing edge regulating device 24 and the cassette main body 21 is represented by B (third operating force). At this time, in the second exemplary embodiment, a force relationship of the elastic members 36 and the like is set to satisfy A<B<C.

Next, engagement operations of a standard size engaging portion 33*a* and a non-standard size engaging portion 34*a* with the cassette 2 will be described in detail using FIGS. 18A to 22B.

Figure 18B:
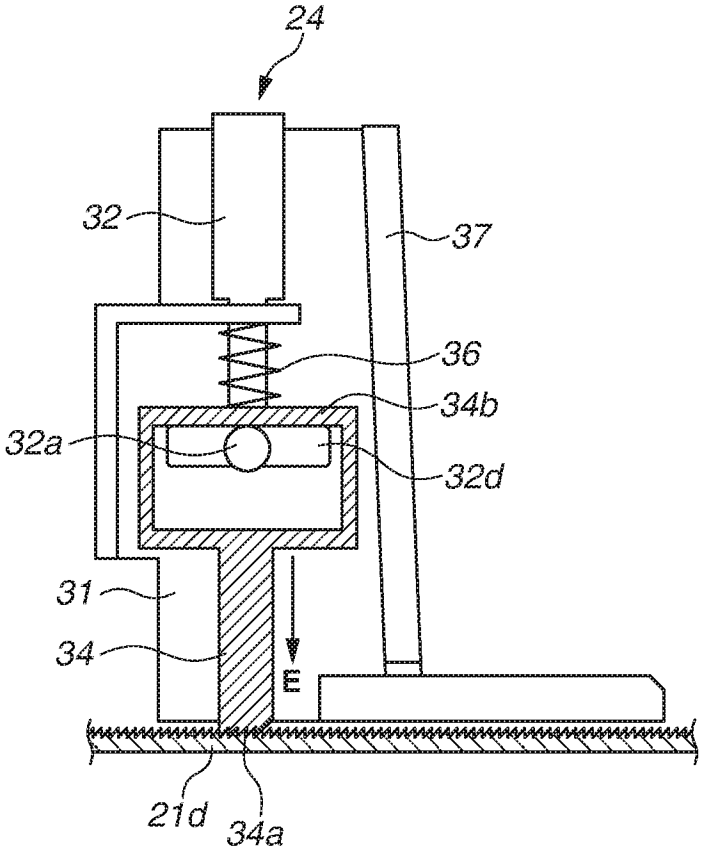
FIGS. 18A and 18B are sectional views illustrating an operation state of the trailing edge regulating device according to the second exemplary embodiment.
Figure 18A:
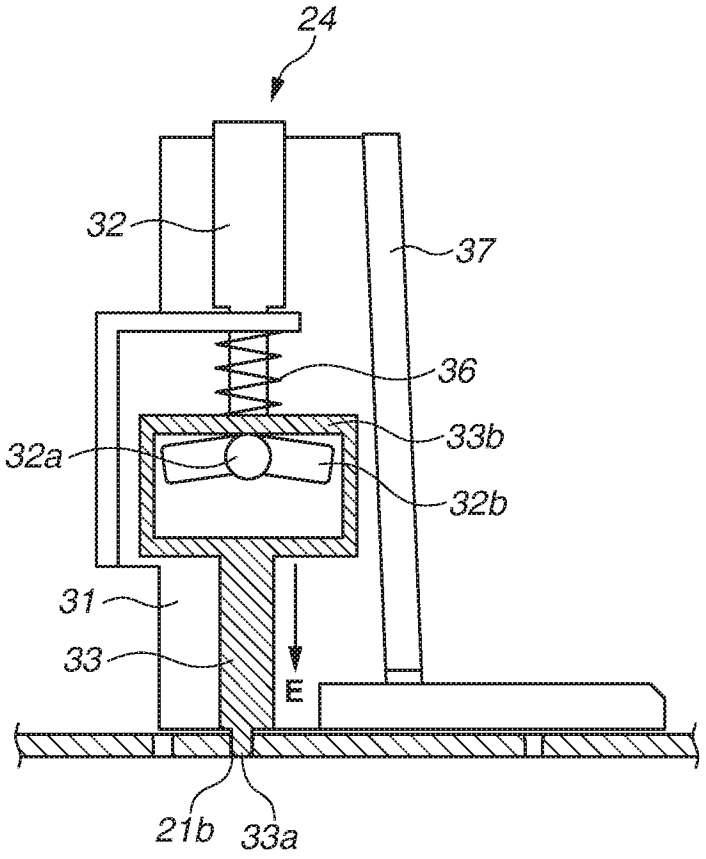
Figure 19B:
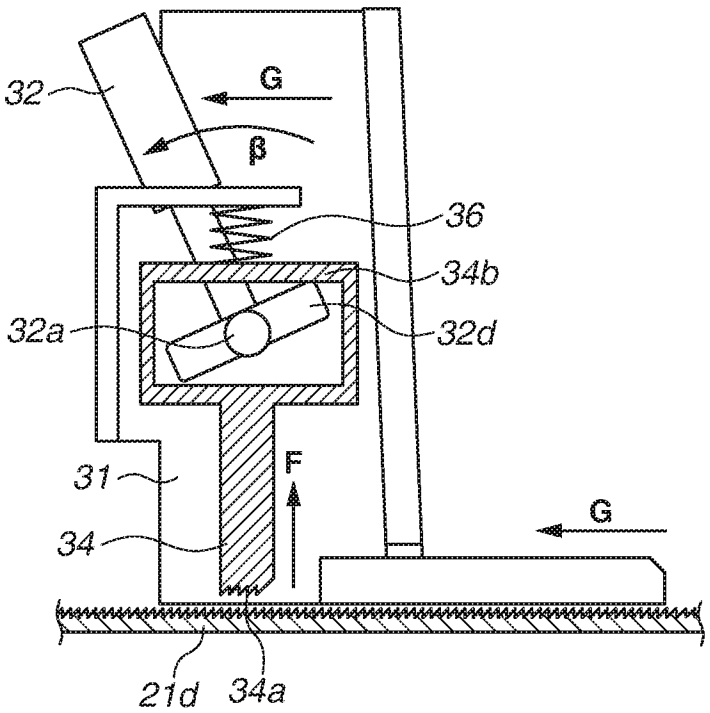
FIGS. 19A and 19B are sectional views illustrating an operation state of the trailing edge regulating device according to the second exemplary embodiment.
Figure 19A:
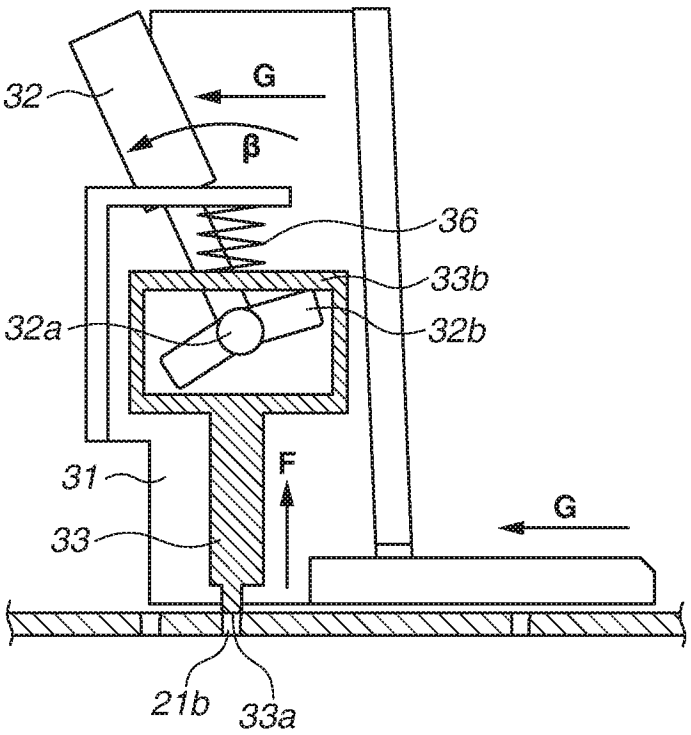
Figure 20B:
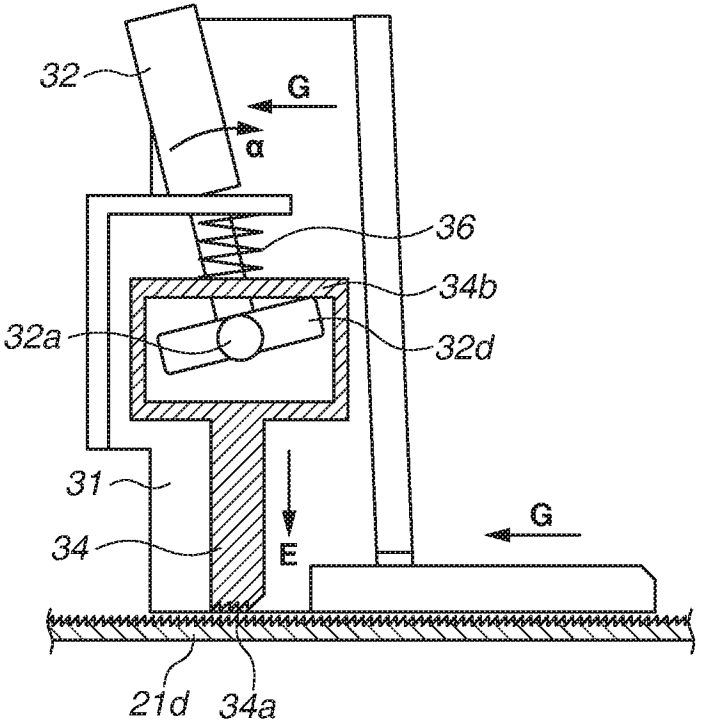
FIGS. 20A and 20B are sectional views illustrating an operation state of the trailing edge regulating device according to the second exemplary embodiment.
Figure 20A:
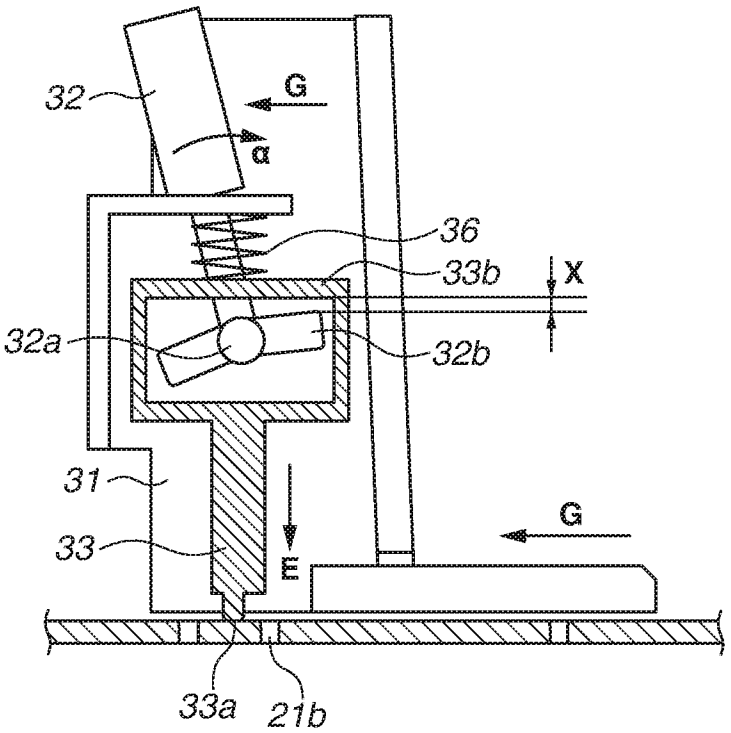
Figure 21B:
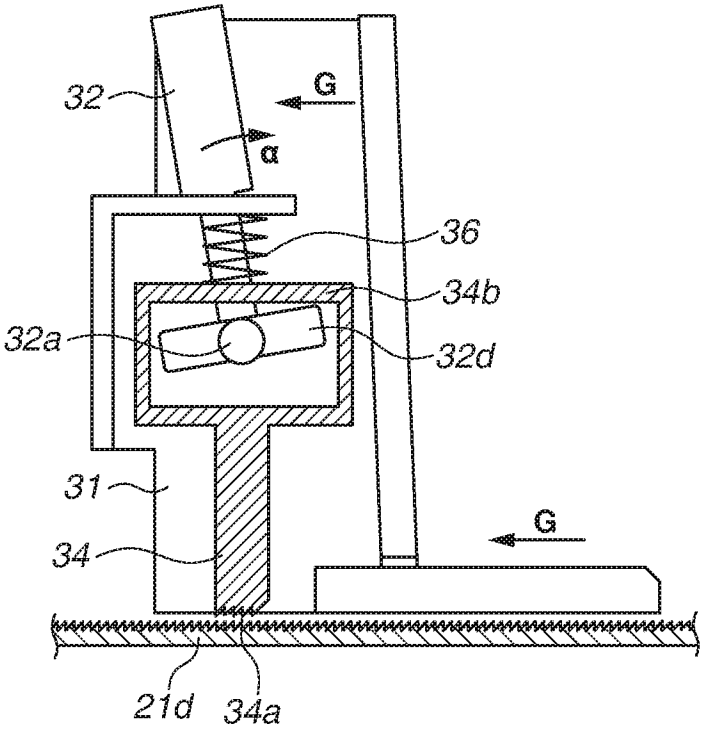
FIGS. 21A and 21B are sectional views illustrating an operation state of the trailing edge regulating device according to the second exemplary embodiment.
Figure 21A:
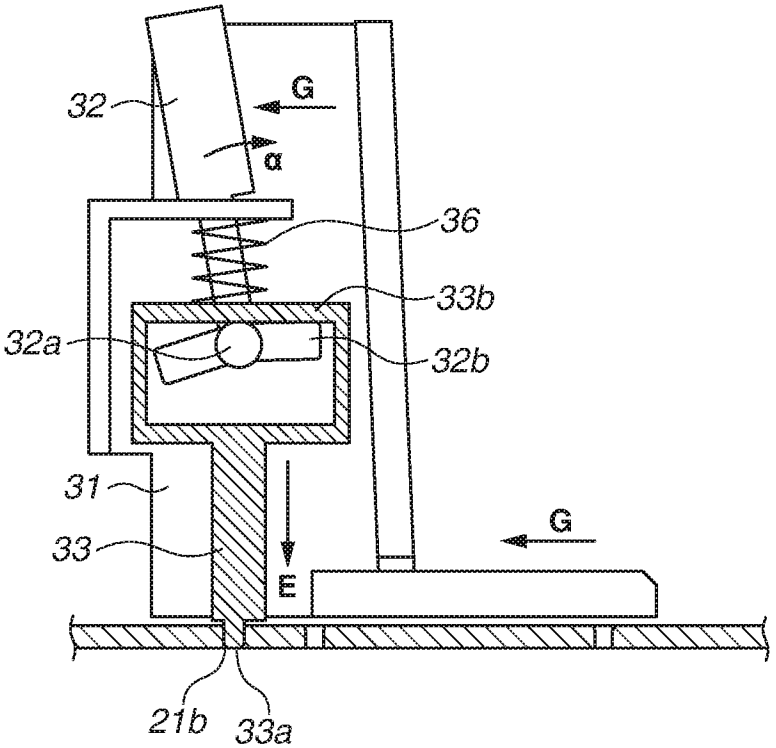
Figure 22B:
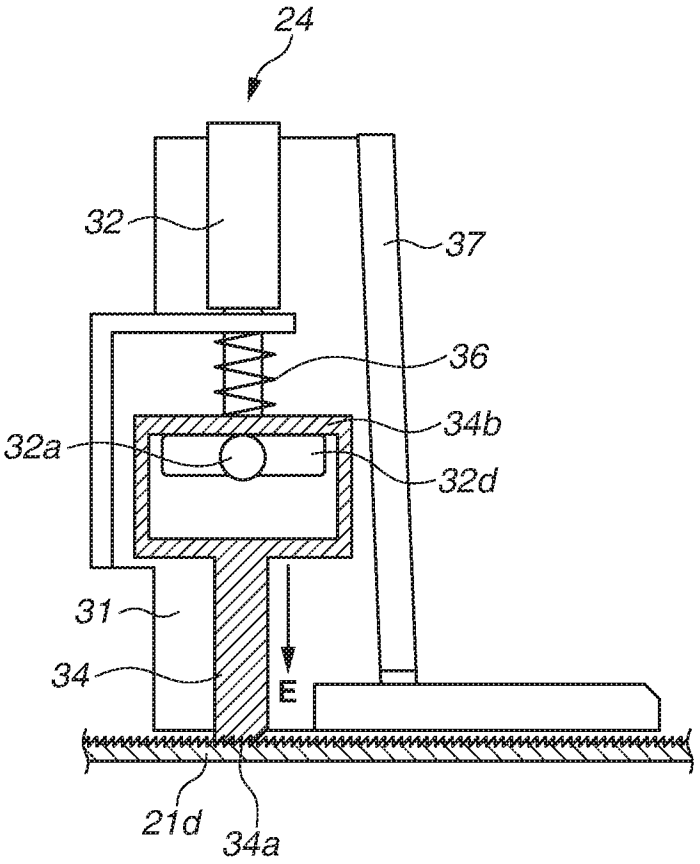
FIGS. 22A and 22B are sectional views illustrating an operation state of the trailing edge regulating device according to the second exemplary embodiment.
Figure 22A:
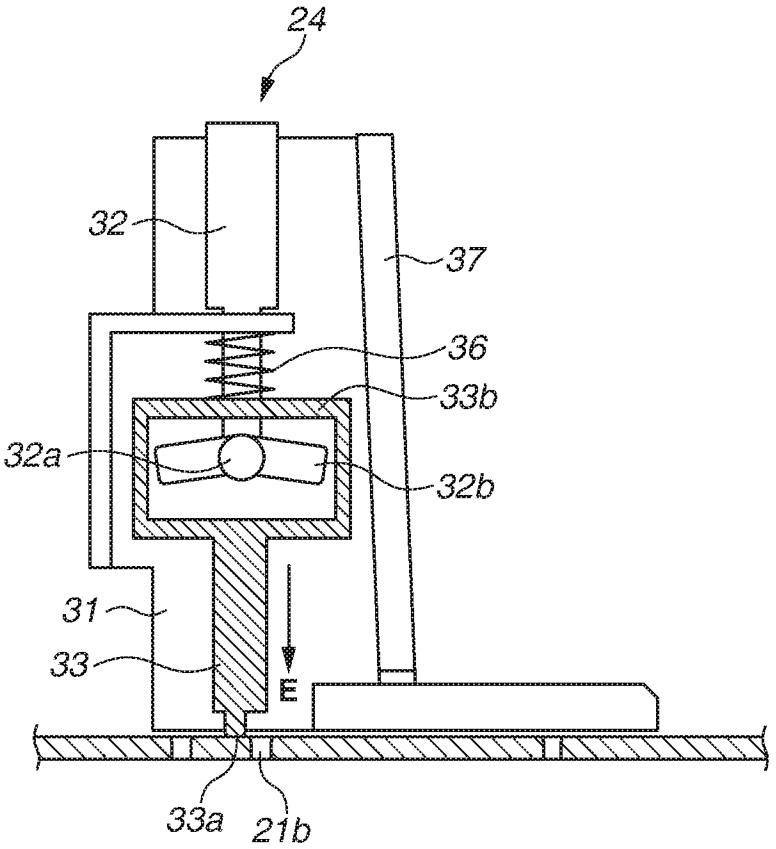

FIGS. 18A and 18B are diagrams illustrating a state where the trailing edge regulating device 24 is fixed to a standard size position. FIGS. 19A and 19B are diagrams illustrating a state where the user releases the fixation of the trailing edge regulating device 24 from the standard size position. FIGS. 20A and 20B are diagrams illustrating a halfway state where the user sets the trailing edge regulating device 24 to a desired position. FIGS. 21A and 21B are diagrams illustrating a state where the trailing edge regulating device 24 is set to the standard size position. FIGS. 22A and 22B are diagrams illustrating a state where the user has set the trailing edge regulating device 24 to a non-standard size position.

FIG. 18A illustrates a state of the standard size fixing member 33, and FIG. 18B illustrates a state of the non-standard size fixing member 34. In this state, the standard size engaging portion 33*a* is engaged with the standard size fixing hole 21*b*, and the trailing edge regulating device 24 is fixed to the standard size position. Further, the non-standard size engaging portion 34*a* is also engaged with the rack gear 21*d*. Hereinafter, positions of the operating lever 32, the standard size fixing member 33, and the non-standard size fixing member 34 in this state are referred to as initial positions.

As illustrated in FIGS. 19A and 19B, the user presses the operating lever 32 in the G direction, so that the operating lever 32 is turned in the 3 direction. When the operating lever 32 turns from the stand-by position to the operation position, the contact portion 32*b* pushes up the standard size contact portion 33*b*, so that the standard size fixing member 33 is moved in the upper direction (F direction). Further, the lever contact portion 32*d* pushes up the non-standard size contact portion 34*b*, and the non-standard size fixing member 34 is moved in the upper direction (F direction). At this time, force necessary for moving the operating lever 32 is the operating force C. Accordingly, as illustrated in FIGS. 19A and 19B, the standard size engaging portion 33*a* is separated from the cassette standard size fixing hole 21*b*, and the non-standard size engaging portion 34*a* is also separated from the cassette non-standard size rack gear 21*d*. In this state, when the user continues to press the operating lever 32 in the G direction, the entire trailing edge regulating device 24 can be moved in the G direction.

FIGS. 20A and 20B illustrate a halfway state where the user is moving the trailing edge regulating device 24 while pressing the operating lever 32 in the G direction to set the trailing edge regulating device 24 to a desired position.

At this time, force necessary for moving the trailing edge regulating device 24 is the operating force B (the sliding resistance between the trailing edge regulating device 24 and the cassette main body 21). This is because the non-standard size fixing member 34 is separated from the rack gear 21*d*, and the standard size fixing member 33 is separated from the standard size fixing hole 21*b*.

Since the operating force B is larger than the operating force A in the G direction that is necessary for separating the non-standard size fixing member 34, the non-standard size fixing member 34 remains separated. Therefore, the user can move the trailing edge regulating device 24 by applying, to the operating lever 32, force equal to or larger than the operating force B that is force smaller than the operating force C. At this time, as illustrated in FIGS. 20A and 20B, the operating lever 32 is pushed back from the operation position, turned in an α direction by a predetermined angle, and positioned in an intermediate position between the stand-by position and the operation position.

In a state where the operating lever 32 is positioned in the intermediate position, the non-standard size fixing member 34 is moved in the lower direction (E direction) by an amount of retraction of the lever contact portion 32*d*. However, as illustrated in FIG. 20B, the operating lever 32 is not fully returned to the initial position. Therefore, the non-standard size engaging portion 34*a* remains separated from the non-standard size rack gear 21*d*. In contrast, the standard size fixing member 33 is moved in the lower direction (E direction) in accordance with the retraction of the lever contact portion 32*b*, and the standard size engaging portion 33*a* reaches a position on a flat portion of the cassette main body 21 to stop thereat. In this state, a predetermined clearance X exists between the contact portion 32*b* and the standard size contact portion 33*b*.

As described above, in the second exemplary embodiment, the trailing edge regulating device 24 is configured so that a timing at which the contact portion 32*b* and the standard size contact portion 33*b* come into contact with each other and a timing at which the contact portion 32*d* and the non-standard size contact portion 34*b* come into contact with each other become different from each other. Therefore, the user can move the trailing edge regulating device 24 while pressing (sliding) the standard size engaging portion 33*a* against (on) the flat portion of the cassette main body 21, in a state where the non-standard size fixing member 34 is separated from the rack gear 21*d*.

When the user further moves the trailing edge regulating device 24 in the G direction while maintaining the state of FIGS. 20A and 20B, the standard size fixing member 33 is lowered by the clearance X in the position where the standard size engaging portion 33*a* has reached the cassette standard size fixing hole 21*b*, as illustrated in FIG. 21A.

Accordingly, the standard size engaging portion 33*a* is engaged with the standard size fixing hole 21*b*.

At this time, as illustrated in FIG. 21B, the non-standard size fixing member 34 remains separated from the rack gear 21*d*. That is, a timing at which the standard size engaging portion 33*a* is engaged with the standard size fixing hole 21*b* is earlier than a timing at which the non-standard size engaging portion 34*a* is engaged with the rack gear 21*d*. Therefore, the user can reliably set the trailing edge regulating device 24 to a position corresponding to the standard size.

When the user releases the hand from the operating lever 32, the operating lever 32 is returned to the initial position as illustrated in FIGS. 18A and 18B. Accordingly, the standard size engaging portion 33*a* is further moved in the lower direction (E direction), and an engagement amount of the standard size engaging portion 33*a* with the standard size fixing hole 21*b* is further increased, so that the trailing edge regulating device 24 is reliably fixed to a standard size fixed position. Further, after the standard size fixing member 33 is moved, the non-standard size fixing member 34 is also moved in the lower direction (E direction), and the non-standard size engaging portion 34*a* is engaged with the non-standard size rack gear 21*d*. Since the engagement of the standard size fixing member 33 is performed in advance of the engagement of the non-standard size fixing member 34, the engagement of the non-standard size fixing member 34 does not exert bad influence on the positioning of the trailing edge regulating device 24 to the standard size position.

When the user wishes to move the trailing edge regulating device 24 to a position corresponding to another standard size, the user can fix the trailing edge regulating device 24 to a desired standard size position by repeating the above-described operation. Therefore, it becomes easier for the user to operate the trailing edge regulating device 24 in the operation using only the standard size.

Further, in the second exemplary embodiment, the description has been given of a case in which the operating lever 32 is pressed in the G direction. However, when the user desires to move the trailing edge regulating device 24 in the opposite direction to the G direction, by pressing the operating lever 32 in the opposite direction to the G direction, the user can perform a similar operation.

FIGS. 22A and 22B illustrate a state where the user has set the trailing edge regulating device 24 to the non-standard size position. When the user releases the hand from the operating lever 32 after moving the trailing edge regulating device 24 to a desired non-standard size position, the operating lever 32 fully turns in the α direction. Accordingly, as illustrated in FIG. 22B, the non-standard size engaging portion 34*a* is engaged with the non-standard size rack gear 21*d*.

At this time, as illustrated in FIG. 22A, the standard size fixing member 33 is pressed in the lower direction (E direction) by the elastic member 36, and the standard size engaging portion 33*a* comes into contact with the flat portion of the cassette main body 21 to stop thereat. That is, the standard size engaging portion 33*a* and the standard size fixing hole 21*b* do not obstruct the positioning of the trailing edge regulating device 24 to a non-standard size position.

As described above, according to the second exemplary embodiment, in addition to the effect of the first exemplary embodiment, the trailing edge regulating device 24 can be moved by pressing the operating lever 32 to the direction (the G direction or the opposite direction to the G direction) in which the user desires to move the trailing edge regulating device 24.

The present invention may have a configuration including a plurality of standard size fixing members 33 and a plurality of lines of standard size fixing holes 21*b*. This enables handling of a case in which the standard size positions of two sizes are close to each other and it is difficult to provide two standard size fixing holes 21*b*.

In the present exemplary embodiment, the description has been given of a configuration in which the standard size engaging portion 33*a* has a chamfered shape. However, the present invention may not have the chamfered shape. In this case, the trailing edge regulating device 24 can be fixed to a non-standard size position nearest to a standard size position. Therefore, a wider range of the non-standard size position can be handled.

Further, in the present exemplary embodiment, the description has been given of a configuration in which the heights (shapes) of the contact portions 32*b* and 32*d* are different from each other. However, a similar effect can be obtained even in a configuration in which lengths (shapes) of the standard size contact portion 33*b* and the non-standard size contact portion 34*b* are different from each other.

Further, in the first and second exemplary embodiments, the description has been given of a configuration in which the present invention is applied to the trailing edge regulating device 24. However, the present invention may be applied to a width direction regulating unit.

Figure 23:
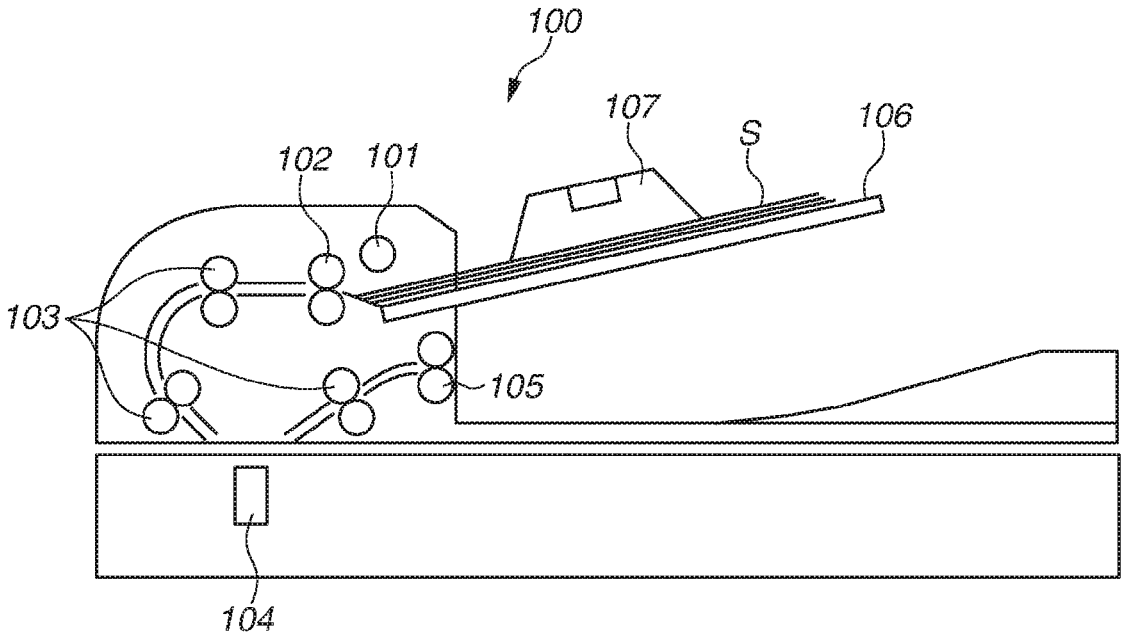
FIG. 23 is a sectional view illustrating a configuration of an image reading device.

Further, the present invention may be applied to a regulating member 107 of an image reading device 100, as illustrated in FIG. 23. In FIG. 23, the image reading device 100 includes a pickup roller 101 and a separation/feeding mechanism 102. The image reading device 100 further includes conveyance roller pairs 103, an image reading unit 104, and a discharge roller pair 105. A sheet S is stacked on a stacking tray 106. The regulating member 107 regulates the position in the width direction of the sheet S stacked on the stacking tray 106.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-262789, filed Dec. 25, 2014, which is hereby incorporated by reference herein in its entirety.

What is claimed is:

1. A stacking device for stacking a sheet, the stacking device comprising:

a stacking portion on which a sheet is stacked;

a regulating member, including a first engaging portion and a second engaging portion and provided on the stacking portion so as to be movable in a first direction and in a second direction that is an opposite direction to the first direction, configured to regulate a position of an end portion of the sheet, the first engaging portion and the second engaging portion being arranged side by side along a direction perpendicular to a moving direction of the regulating member;

a first engaged portion provided in the stacking portion for positioning the regulating member to a position corresponding to a standard-sized sheet by being engaged with the first engaging portion;

a second engaged portion provided in the stacking portion for positioning the regulating member to a position corresponding to a non-standard-sized sheet by being engaged with the second engaging portion, the first engaged portion and the second engaged portion being arranged side by side along the direction perpendicular to the moving direction of the regulating member;

a one-piece moving member movable between a stand-by position and an operation position distant from the stand-by position; and a releasing unit including a first releasing unit coupled to the one-piece moving member and configured to move the first engaging portion from a first engagement position where the first engaging portion is engaged with the first engaged portion to a first release position where the first engaging portion is not engaged with the first engaged portion, by the one-piece moving member moving to the operation position, and a second releasing unit coupled to the one-piece moving member and configured to move the second engaging portion from a second engagement position where the second engaging portion is engaged with the second engaged portion to a second release position where the second engaging portion is not engaged with the second engaged portion, by the one-piece moving member moving to the operation position, wherein, when the one-piece moving member moves from the operation position to the stand-by position, the releasing unit moves the second engaging portion to the second engagement position after moving the first engaging portion to the first engagement position, and the regulating member is movable to the first direction or the second direction in a state where the first engaging portion is moved to the first release position by the releasing unit, and the second engaging portion is engaged to the second engaged portion.

2. The stacking device according to claim 1, wherein the first engaged portion includes a hole for guiding the first engaging portion, and wherein the second engaged portion includes a rack gear having a plurality of teeth.

3. The stacking device according to claim 2, wherein the first engaging portion has a protrusion to be inserted into the hole, and wherein the second engaging portion has a teeth shape, including more than one tooth, to be engaged with the rack gear.

4. The stacking device according to claim 3, wherein the protrusion has a slope guided to the hole.

5. The stacking device according to claim 1, wherein first operating force that is necessary force for moving the first engaging portion from the first engagement position to the first release position by the first releasing unit is larger than second operating force that is necessary force for moving the second engaging portion from the second engagement position to the second release position by the second releasing unit.

6. The stacking device according to claim 5, wherein sliding resistance arising when the regulating member moves is smaller than the first operating force, and is larger than the second operating force.

7. The stacking device according to claim 1, wherein the regulating member moves in the first direction by the one-piece moving member being pressed in the first direction, and the regulating member moves in the second direction by the one-piece moving member being pressed in the second direction.

8. The stacking device according to claim 1, wherein the one-piece moving member is turnable around a rotation axis, and wherein the first releasing unit and the second releasing unit are configured to respectively move the first engaging portion and the second engaging portion in a vertical direction by turning of the one-piece moving member.

9. The stacking device according to claim 1, wherein, in a state where the one-piece moving member is positioned in an intermediate position between the operation position and the stand-by position, the first engaging portion is positioned in the first engagement position and the second engaging portion is positioned in the second release position.

10. The stacking device according to claim 1, wherein the regulating member regulates a position of a trailing edge of a sheet.

11. An image forming apparatus comprising:

an image forming unit;

a stacking portion on which a sheet on which an image is to be formed by the image forming unit is stacked;

a regulating member, including a first engaging portion and a second engaging portion and provided on the stacking portion so as to be movable in a first direction and in a second direction that is an opposite direction to the first direction, configured to regulate a position of an end portion of the sheet, the first engaging portion and the second engaging portion being arranged side by side along a direction perpendicular to a moving direction of the regulating member;

a first engaged portion provided in the stacking portion for positioning the regulating member to a position corresponding to a standard-sized sheet by being engaged with the first engaging portion;

a second engaged portion provided in the stacking portion for positioning the regulating member to a position corresponding to a non-standard-sized sheet by being engaged with the second engaging portion, the first engaged portion and the second engaged portion being arranged side by side along the direction perpendicular to the moving direction of the regulating member;

a one-piece moving member movable between a stand-by position and an operation position distant from the stand-by position; and a releasing unit including a first releasing unit coupled to the one-piece moving member and configured to move the first engaging portion from a first engagement position where the first engaging portion is engaged with the first engaged portion to a first release position where the first engaging portion is not engaged with the first engaged portion, by the one-piece moving member moving to the operation position, and a second releasing unit coupled to the one-piece moving member and configured to move the second engaging portion from a second engagement position where the second engaging portion is engaged with the second engaged portion to a second release position where the second engaging portion is not engaged with the second engaged portion, by the one-piece moving member moving to the operation position, wherein, when the one-piece moving member moves from the operation position to the stand-by position, the releasing unit moves the second engaging portion to the second engagement position after moving the first engaging portion to the first engagement position, and the regulating member is movable to the first direction or the second direction in a state where the first engaging portion is moved to the first release position by the releasing unit, and the second engaging portion is engaged to the second engaged portion.

* * * * *